US012523106B2

(12) United States Patent
Studer

(10) Patent No.: US 12,523,106 B2
(45) Date of Patent: Jan. 13, 2026

(54) DRILLING SYSTEM FOR RECOVERING NEARLY UNDISTURBED CORES FROM LOOSE TO SOLID GROUND

(71) Applicant: STUMATEC AG, Uebeschi (CH)

(72) Inventor: Daniel Studer, Höfen bei Thun (CH)

(73) Assignee: Stumatec AG, Uebeschi (CH)

( * ) Notice: Subject to any disclaimer, the term of this patent is extended or adjusted under 35 U.S.C. 154(b) by 0 days.

(21) Appl. No.: 18/029,218

(22) PCT Filed: Sep. 24, 2021

(86) PCT No.: PCT/EP2021/076384
§ 371 (c)(1),
(2) Date: Mar. 29, 2023

(87) PCT Pub. No.: WO2022/069372
PCT Pub. Date: Apr. 7, 2022

(65) Prior Publication Data

US 2023/0366282 A1 Nov. 16, 2023

(30) Foreign Application Priority Data

Sep. 30, 2020 (CH) ..... 01240/20

(51) Int. Cl.
*E21B 25/02* (2006.01)
*E21B 1/14* (2006.01)

(52) U.S. Cl.
CPC ..... *E21B 25/02* (2013.01); *E21B 1/14* (2020.05)

(58) Field of Classification Search
CPC ..... E21B 25/02; E21B 1/14; E21B 25/00
See application file for complete search history.

(56) References Cited

U.S. PATENT DOCUMENTS 9,551,188 B1 1/2017 Christy et al.
2003/0089526 A1* 5/2003 Beeker ..... E02D 1/04 175/58

(Continued)

FOREIGN PATENT DOCUMENTS

CN 105927175 A 9/2016
DE 3879045 T2 9/1993

(Continued)

*Primary Examiner* — Nicole Coy
*Assistant Examiner* — Nicholas D Wlodarski
(74) *Attorney, Agent, or Firm* — The Webb Law Firm

(57) ABSTRACT

The device is operated with a conventional rotary drive with pile hammer. The torque and the ramming impacts of the drill head are transmitted to a drilling initial tube with drill bit. A sleeve without rotation stands inside the rotating initial tube. It rests at the bottom on the inside of the drill bit rotating below it. As a special feature, the sleeve is connected to the rotating drill head by means of a sleeve adapter with axially consecutive parts that can be rotated against each other and a PFR pressure, flushing and recovery tube connected to it. The PFR rotates with the drill head and the drill pipe, and the sleeve adapter communicates with the non-rotating sleeve. The PFR is used firstly to apply compressive force to the sleeve from above, secondly to flush it by guiding the flushing water for drilling in the PFR and forcing it out of the sleeve, and thirdly to allow the sleeve to be recovered for an almost undisturbed drilling test.

13 Claims, 23 Drawing Sheets

(56) References Cited

U.S. PATENT DOCUMENTS

| | | | | |
|---|---|---|---|---|
| 2012/0234607 | A1* | 9/2012 | Kinsella | E21B 25/02 175/403 |
| 2012/0261189 | A1* | 10/2012 | Gaugh | E21B 7/24 175/20 |
| 2019/0040701 | A1 | 2/2019 | Mageren | |

FOREIGN PATENT DOCUMENTS

| | | | |
|---|---|---|---|
| DE | 112016005721 | T5 | 9/2018 |
| EP | 2050923 | A1 | 4/2009 |
| KR | 101544769 | B1 | 8/2015 |

* cited by examiner

DRILLING SYSTEM FOR RECOVERING NEARLY UNDISTURBED CORES FROM LOOSE TO SOLID GROUND

CROSS-REFERENCE TO RELATED APPLICATIONS

This application is the United States national phase of International Application No. PCT/EP2021/076384 filed Sep. 24, 2021, and claims priority to Swiss Patent Application No. 01240/20 filed Sep. 30, 2020, the disclosures of which are hereby incorporated by reference in their entireties.

BACKGROUND OF THE INVENTION

Field of the Invention

This drilling system relates to a method and a device for retrieving drill cores from, in particular, loose but also solid ground, whereby the drill core samples can be retrieved and deposited almost undisturbed.

By this is meant that a cylindrical drill core is taken from the ground in a hollow cylindrical sleeve, the so-called drill core catcher or drill sample catcher, and brought to the surface. Such cores measure, for example, about one meter in length and 10 cm to 20 cm in diameter. However, they can also be considerably larger or smaller, depending on the requirements and the dimensions of the drilling equipment. At the surface, this drill core is ejected from the hollow cylindrical sleeve and then lies freely accessible horizontally, for example on the inner shell of a half cylinder or on a flat base. To the extent that such a soil sample partially disintegrates due to material consistency when ejected from the sleeve, it is no longer 100% undisturbed. However, the sleeve can also be equipped on the inside with a liner made of, for example, rigid PVC or another suitable material, which fits snugly against the sleeve's inner wall, so that this liner is also pushed over the soil material along with the sleeve during the drilling operation. In this case, after the sleeve has been recovered, the liner is ejected from it, with the drill core in it unchanged, just as it was in the ground, and it can be opened later, for example with diametrical cuts, in tranches, so that the sample is then completely undisturbed. One advantage of using a liner is that after recovery from the sleeve, any volatile contaminants present in the drill core are trapped in it and remain preserved in the drill core. However, the use of liners is more complex and also more expensive than drilling without such liners.

Soil samples recovered in this manner provide information about soil properties and, in particular, about any contaminants that have penetrated the soil over time. Reliable damage registers can thus be drawn up and suitable measures for the remediation of such soils can be initiated. It is particularly interesting for agriculture to gain knowledge about soil qualities, the mineral composition of humus soils and their nutrient richness, or to learn about possible soil deficiencies. Knowledge can then be gained about which soils are suitable for which crops and how fertilizers should be applied, which ultimately promotes ecological and high-yield management of agricultural land. Such core drilling is also suitable for taking soil samples in old landfills, in soils suspected of being contaminated and in loose rock formations, i.e. also in fine sand layers, in peat layers and in marine chalk. The drilling method also works in soil layers that are in groundwater.

Description of Related Art

Well-known and often used is the taking of soil samples for geotechnical evaluations from solid ground. Here, there is an internationally established Standard Penetration Test (SPT), as defined in the American Society for Testing and Materials (ASTM) standard D1586. The test uses a thick-walled sample tube with an outer diameter of 50.8 mm and an inner diameter of 35 mm and a length of about 650 mm. This is driven into the ground at the bottom of a borehole by impacts of a slide hammer with a mass of 63.5 kg falling over a distance of 760 mm. The sample pipe is driven 150 mm into the ground, and then the number of blows required to make the pipe penetrate 150 mm at a time to a depth of 450 mm is recorded. The sum of the number of blows required for the second and third 6-inch penetrations is called the "standard penetration resistance" or "N-value," which is expressed in beats per foot (bpf). This value is fundamental to many of the various types of geotechnical calculations, such as bearing capacity and settlement estimates. In cases where 50 blows is not sufficient to advance the penetration through a 150 mm interval, the penetration is recorded after 50 blows. The blow count gives an indication of the density of the soil and is used in many empirical geotechnical engineering formulas.

While drilling in solid ground is well established in the state of the art, drilling and especially the recovery of drill cores from loose ground is particularly demanding, because in addition to the rotating drill bit, pile driving is required for drilling, i.e. hard impacts on the drill head, which then has to transfer these force impacts to the entire drill pipe, i.e. to the drill tubes, the core barrel and the drill bit attached to it. Accordingly, all parts are subjected to enormous mechanical and thermal stresses, and their service life therefore often leaves much to be desired. For this reason, there is still no really convincing drilling system that delivers reasonably acceptable core qualities and, above all, also offers acceptable service lives of the drilling system used.

The extraction of cylindrical soil samples from loose ground has so far been carried out with already very specifically designed drilling rigs, which enclose a drill pipe with an initial tube with drill bit at the lower end, whereby drilling into the ground is carried out by rotating the drill pipe and thus the initial tube and the drill bit and simultaneously hammering and therefore ramming. Inside the initial tube, a sleeve is inserted with little clearance as a drill core catcher. This sleeve is located at the bottom of the drill bit on a projection projecting radially inwards from the drill bit.

Such a drilling method is described in EP 2 050 923. There it is described as essential that the drill core catcher or sleeve must be held inside the initial tube to prevent its rotation, and for this purpose a special fixing rod is proposed which runs throughout from top to bottom in the drill pipe in a rotationally fixed manner—i.e. without rotation—and is thus intended to secure the sleeve in a rotationally fixed manner. Practice shows, however, that a fixing rod is by no means necessary to hold the sleeve on the drill rig so that it cannot rotate, because the sleeve is clamped anyway by the drill core itself, which enters the sleeve via the drill core when the sleeve is lowered or sunk, and this reliably prevents rotation of the sleeve. In principle, therefore, the sleeve does not rotate during drilling, but is pressed down over the drilled-out core in the axial direction without rotation together with the movement of the initial pipe rotating around it, and is sunk down over this core. Practical experience therefore shows that the task which EP 2 050 923 claimed to solve was a non-actual one, i.e. it did not exist at all. The drill core growing into the sinking sleeve will hardly rotate, or at most only very slightly, simply because of its connection with the ground. A fixing rod to hold the sleeve in place and prevent its rotation is therefore superfluous. It can even have a negative effect, namely when the sleeve rotates a few degrees in the direction of rotation of the core bit under certain conditions of the substrate despite the rotation-resistant fixing rod. This does not affect the quality of the drill core, but when such a fixing rod is used, it cannot absorb the resulting torsion and shears off. This results in unplanned and long drilling interruptions and time-consuming improvisation work to somehow recover the core.

Normally, however, after a drilling section is reached, it is stopped and the sleeve is pulled up out of the initial tube together with the drill core and the drill core is pushed out of the sleeve in a horizontal position and the empty sleeve can be reinserted into the initial tube. For deeper drilling, the initial tube with the drill core can be brought to deeper positions with sectional extensions of the drill tube. As far as this is presented in EP 2 050 923.

In the prior art, so-called rope core drilling methods are known by which drill cores can be easily recovered from solid rock or solid ground. These methods work with devices including a clinker closure, which involves a complicated construction that is not suitable for drilling in loose ground because, as a result of the necessary ramming impacts, these devices for recovering drill cores would break down within a very short time. In addition, a casing or core catcher cannot be pressed downward with ropes over an exposed drill core.

SUMMARY OF THE INVENTION

The difficulties to take such cores from a loose soil are manifold and are mostly underestimated extraordinarily. The drilling rig develops up to 28,000 Nm of torque, the pile driving impacts cause enormous force shocks, i.e. those with very high force peaks with individual impact energies of up to 500 Nm, which are used with frequencies of e.g. 2400 $min^{-1}$, which places extreme demands on the construction and its stability, which are difficult to determine purely by calculation. Many parts used on a trial basis proved to be worn and unusable after a short period of use. Reference is made here, for example, to the Sonnic hammer drill, or more generally to all commercially available drill drives and hammer drills, for which this applies throughout.

Less suitable drilling methods may also result in contamination from certain strata depths being carried downward from the drill bit or core barrel in the course of the drilling operation. In such cases, a recovered drill core sample can no longer be described as approximately undisturbed.

To date, no drilling equipment is available that can be said to be truly suitable for the collection of nearly undisturbed soil samples not only from solid bedrock, but especially from loose bedrock in the form of cores. No known device functions reliably over long periods of use and enables cores to be taken and recovered, especially from loose ground, in an efficient and simple manner, so that many cores per time could be recovered as intact as possible.

Against this background, the present invention sets itself the task of specifying a drilling system, that is, a method and a device for taking approximately undisturbed soil samples from, in particular, loose ground, but equally from solid subsoil, which drilling system is clearly superior to conventional methods in several respects. The actual drilling should be faster and possible drilling interruptions should be reduced to a minimum time window. The device is said to offer a much longer service life than conventional drill pipes and their components. The boreholes should provide approximately undisturbed soil samples and, depending on their nature, should be able to be secured in such a way that, in the event of disintegration due to the consistency of the material, the informative value of the sample examination does not suffer or suffers only imperceptibly.

This task is solved by a method according to the features described herein and with the device for carrying it out according to the features described herein.

BRIEF DESCRIPTION OF THE DRAWINGS

In the following description, this drilling system, that is, the apparatus and the method operated therewith are presented and the individual features and aspects of the method and the apparatus are described in an understandable manner. The particular features and operation of the apparatus and its components are exhaustively explained.

There is shown.

DESCRIPTION OF THE INVENTION

Figure 1:
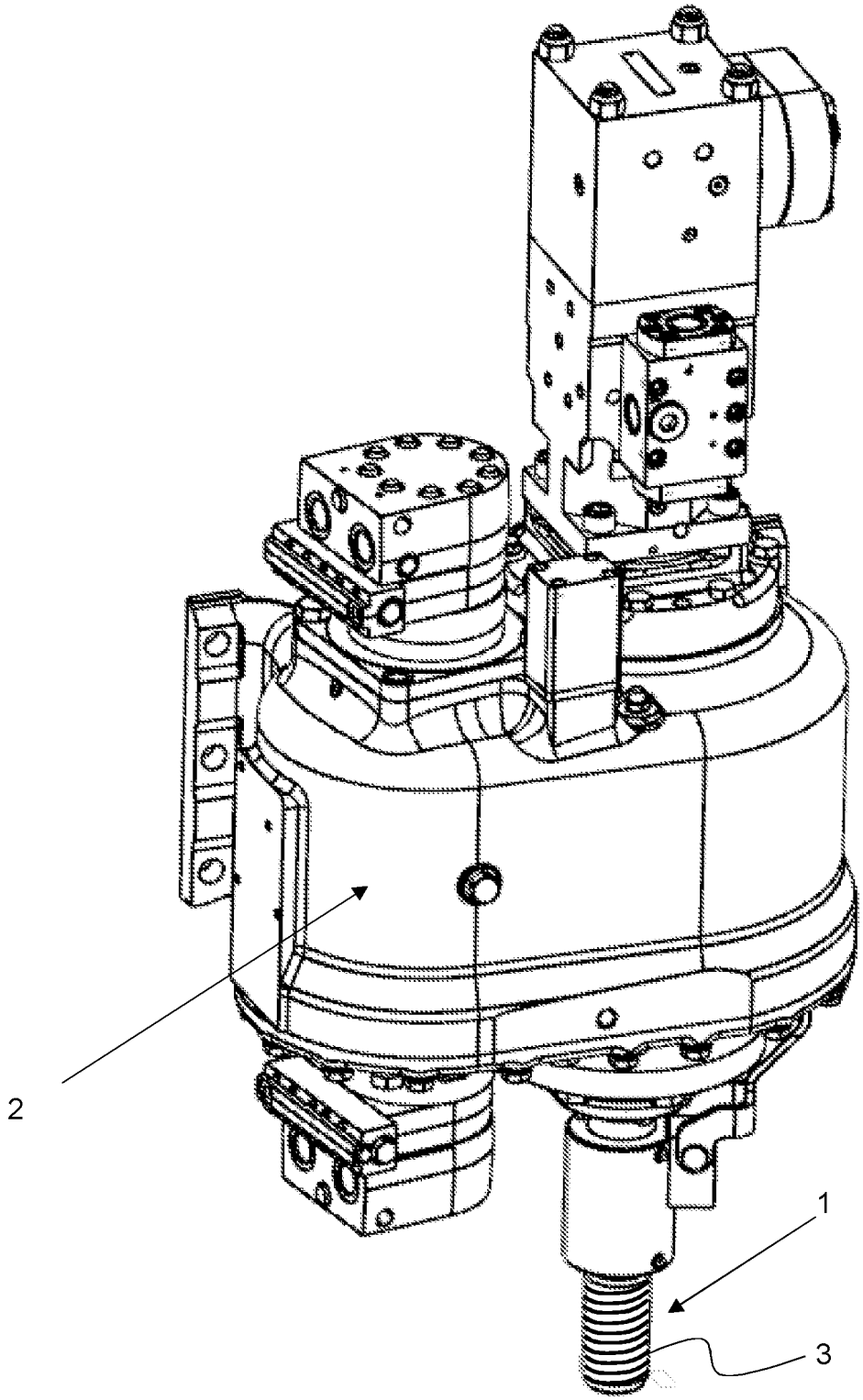
FIG. 1: A hammer drill with drive and hammer for hammering rotation of the drill head.
Figure 2:
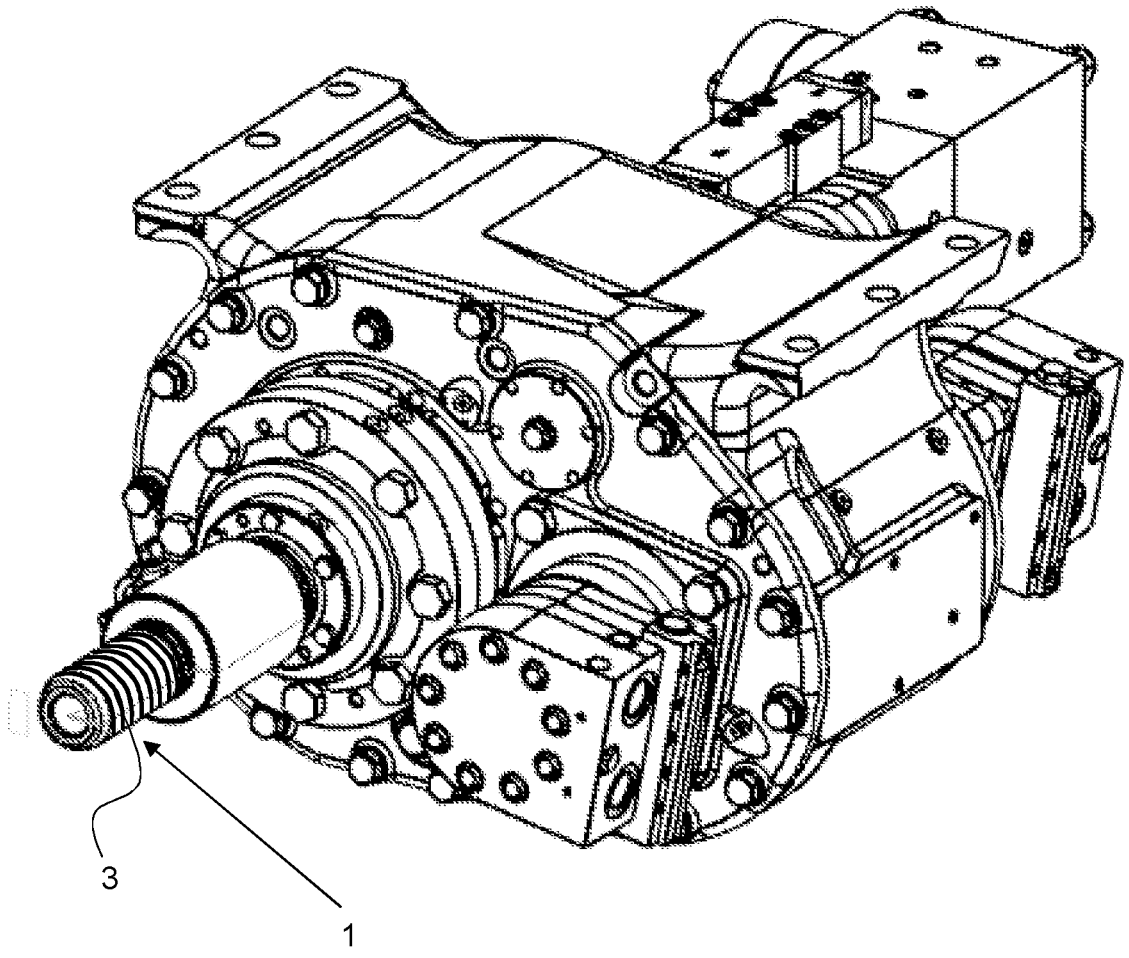
FIG. 2: The hammer drill in a lying position, in a view from below.
Figure 3:
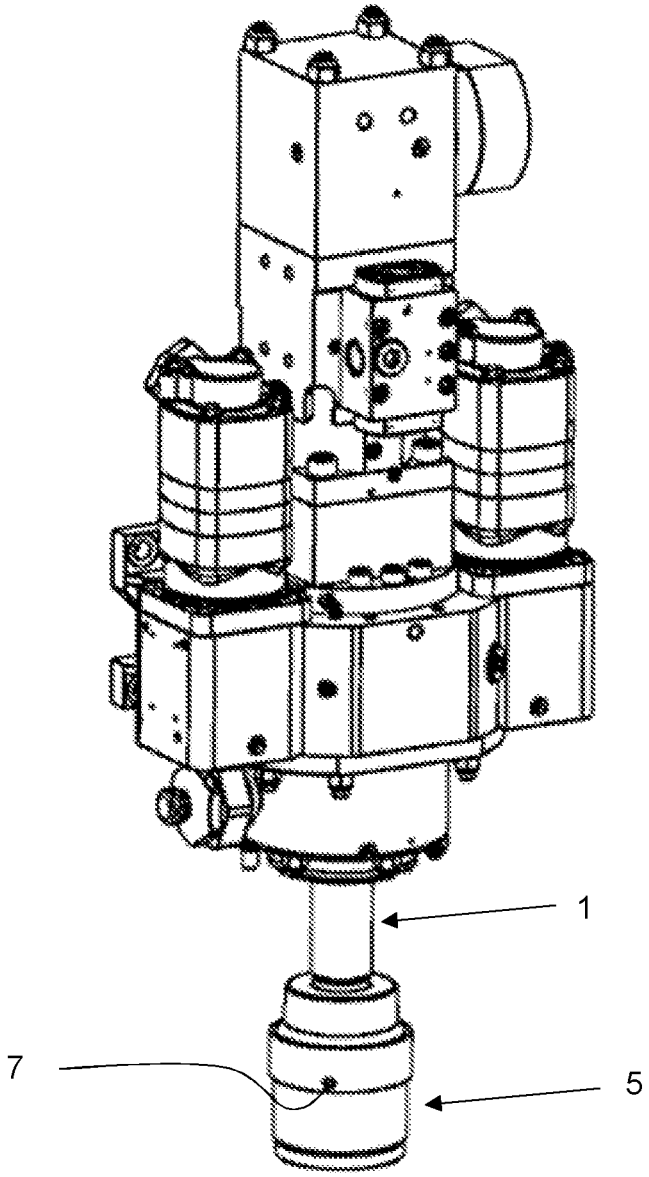
FIG. 3: The hammer drill with drill head in the upright position.
Figure 4:
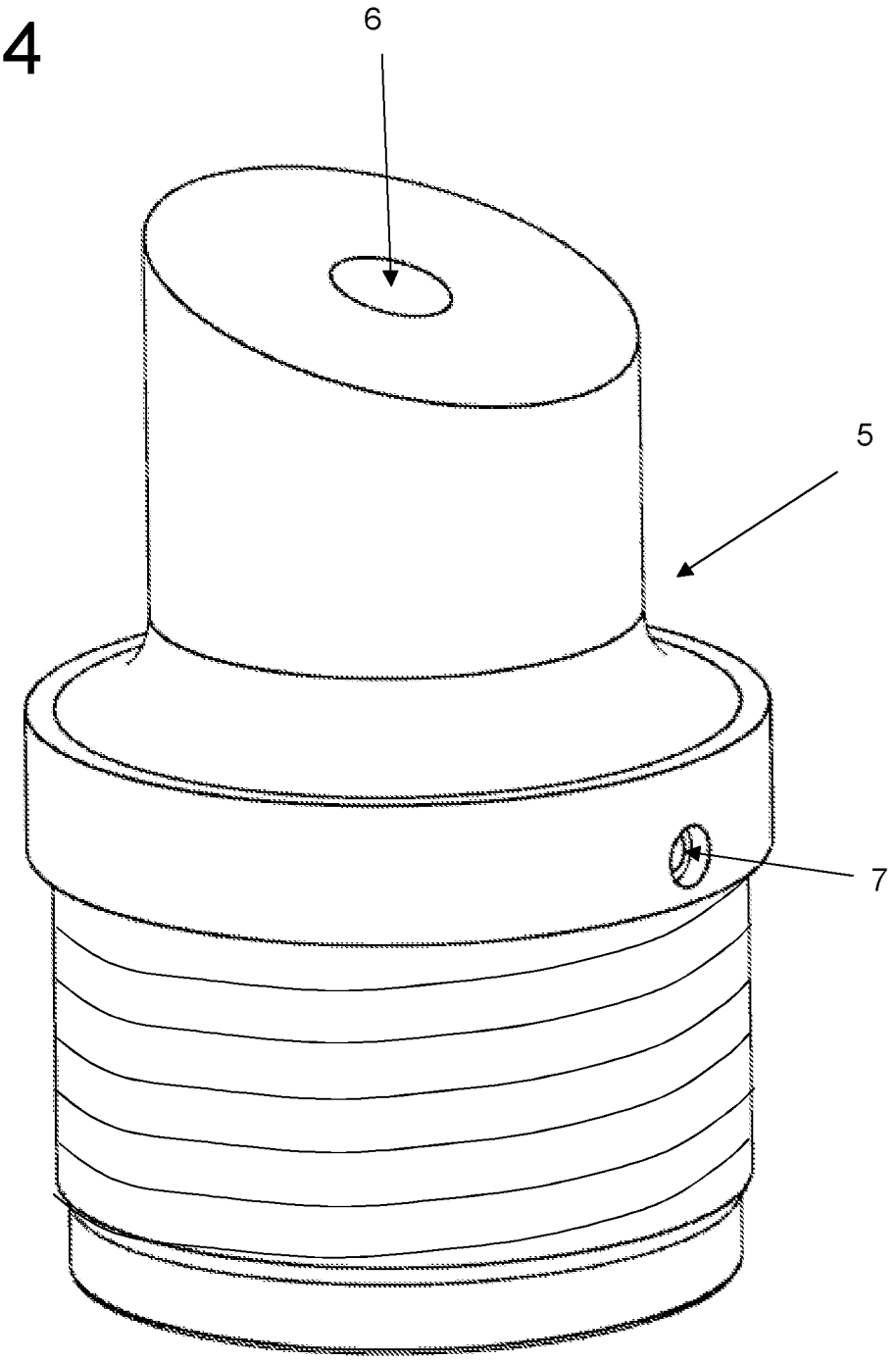
FIG. 4: A drill head shown separately, with its external thread for screwing into a drill pipe.
Figure 5:
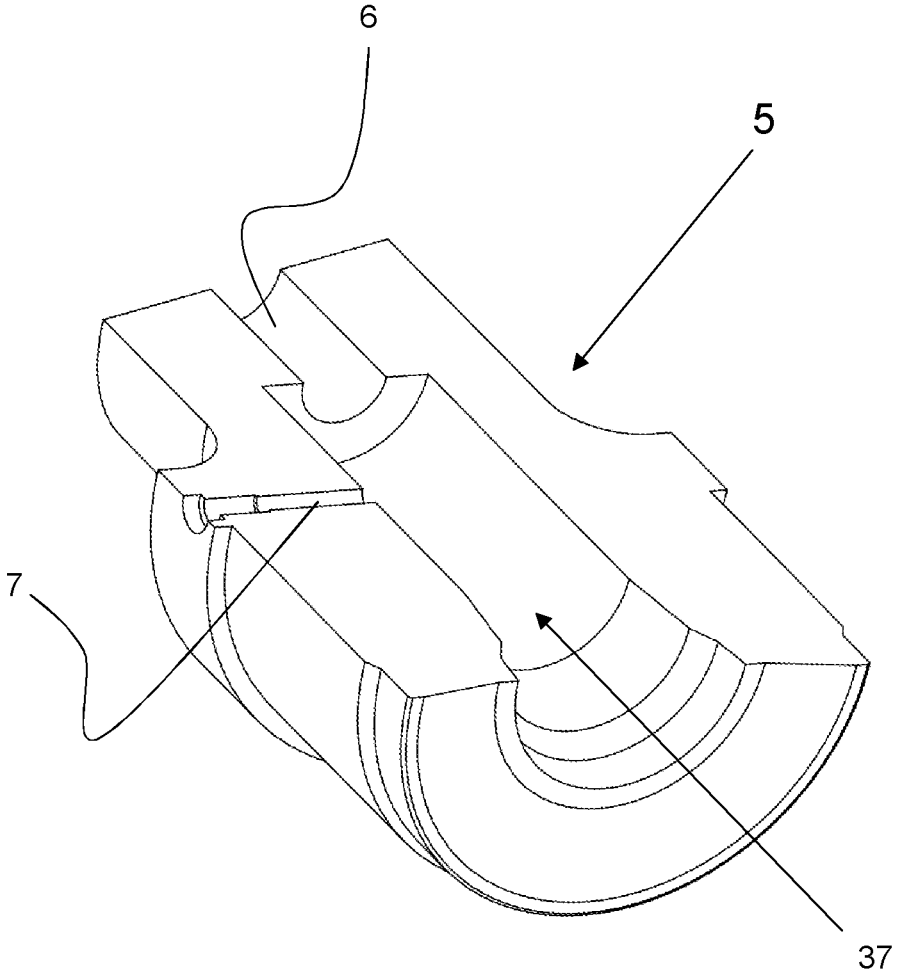
FIG. 5: The drill head shown in FIG. 4 in longitudinal section, with central axial hole for flushing and radial hole for venting.

First, FIG. 1 shows a hammer drill with drive and hammer for hammering rotation of the drill head, as such hammer drills are commercially available. At the bottom, the output shaft 1 protrudes, which has a thread 3 and is rotated by a laterally arranged hydraulic drive 2. The hammer drill internally encloses a hammer mechanism which applies ram blos to the output shaft 1 from above. The rotational speeds of the drive vary from about 5 w0 to 1000 rpm. The lower the speed, the higher the torque applied to the output shaft 1, which reaches about 15 kNm at 50 rpm. The hammering impacts are generated at hydraulic pressures of up to 200 bar and have impact energies of up to 500 Nm, with impact cadences of up to 2400 $min^{-1}$. In FIG. 2, this hammer drill is shown in a view from below with the output shaft 1 protruding below and in FIG. 3 in an upright position of use, as the hammer drill is used, with the drill head 5 connected to the output shaft 1 below, for which purpose the thread 3 of the output shaft 1 has been screwed into the drill head. FIG. 4 shows a drill head separately and enlarged, with its external thread for screwing into a drill pipe, and in FIG. 5 this drill head is still shown in a longitudinal section. One can see the central axial bore 6 for flushing, the axial bore 37 with inner wall from below, and a radial bore 7 for venting.

Figure 6:
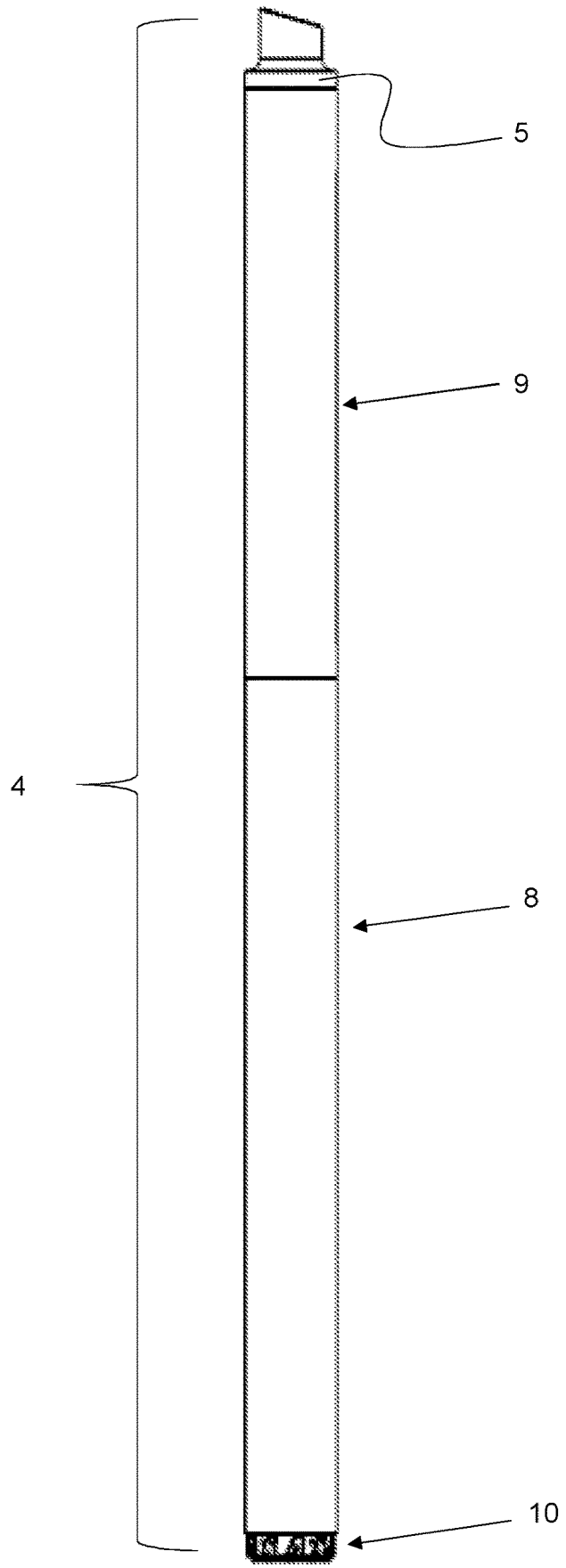
FIG. 6: The assembled drill system consisting of drill head, drill pipe, initial pipe and drill bit attached thereto.

From FIG. 6 on, the drilling system according to the invention is now presented and described. Here, the drilling system 4 is first seen in its entirety from the outside. It consists very simply in principle of only eight parts, namely the following visible from the outside from top to bottom:

1. Drill head 5
2. One or more drill pipe sections screwed together form the drill pipe 9
3. Initial tube 8
4. Drill bit 10

Figure 11:
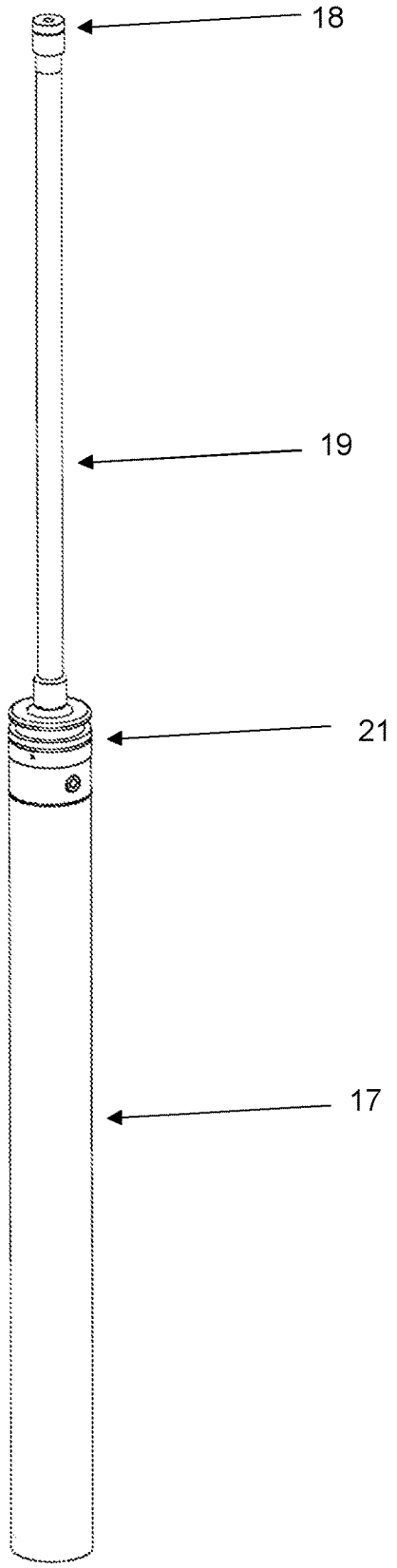
FIG. 11: Assembled and viewed from top to bottom: A Pressure, Flush and Recovery pipe adapter (PFR adapter), followed by a pressure, flush and recovery pipe PFR, and at the bottom of the pressure, flush and recovery pipe PFR a sleeve or core catcher.

Inside the drill pipe 9 or drill pipe sections and the initial pipe 8, and therefore not visible in FIG. 6, are, from top to bottom, as shown in FIG. 11, the following parts:

5. Pressure, flushing and recovery pipe adapter (PFR adapter) 18
6. One or more pressure, flushing and recovery tubes (PFR) screwed together 19
7. Sleeve adapter 21
8. Sleeve 17

Figure 7:
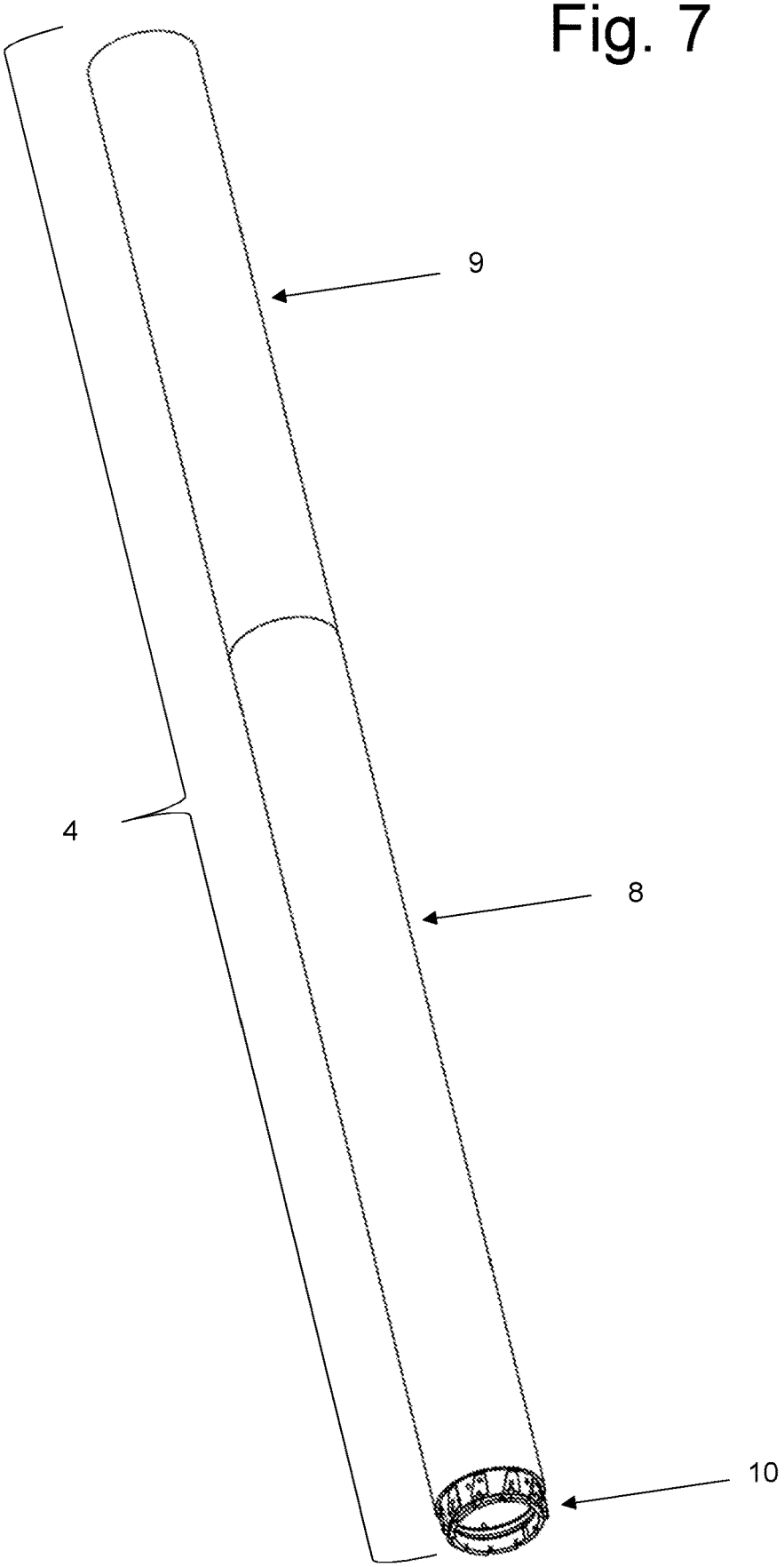
FIG. 7: The composite drilling system of FIG. 6, viewed from below at an angle.
Figure 8:
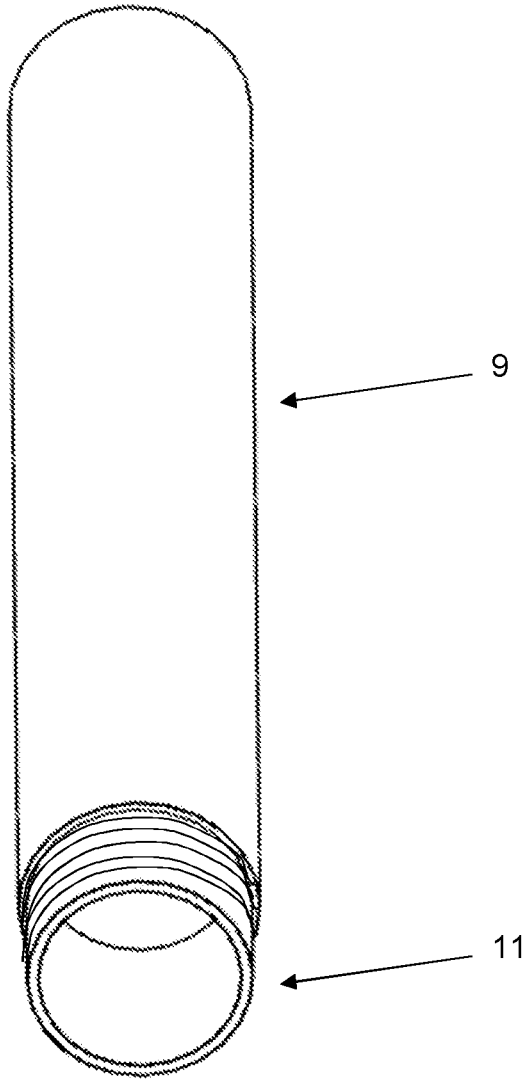
FIG. 8: A drill pipe as an extension piece, viewed obliquely from below.
Figure 9:
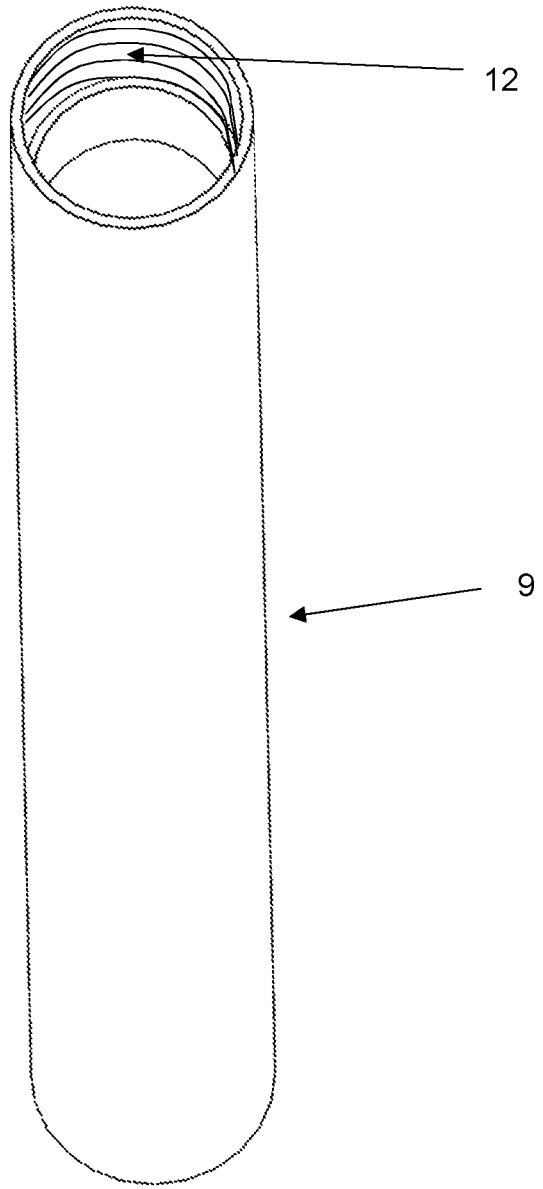
FIG. 9: The drill pipe of FIG. 8 as an extension piece, seen obliquely from above.

First, FIG. 6 shows the assembled drilling system 4 with the drill head 5 for the drive at the top. It is screwed into an internal thread of the adjacent drill pipe 9 and can then drive and rotate it in a clockwise direction, as seen from above. Here, the lower external thread of the drill pipe 9 is screwed into a matching internal thread at the top of the initial pipe 8. These threads are relatively coarse threads milled out of the material of the tubes. For each screwing together, which is done with the aid of the rotating drill head 5, the threads are preferably re-greased. With one or more drill pipe sections, the drill pipe 9 can be extended to advance correspondingly deeper into the ground. The drill pipe sections advantageously measure approx. 1 meter in length. Then they are handy and can be carried by one person and deposited as a stack at the drilling rig for insertion. The initial tube 8 carries a drill bit 10 at its lower end. FIG. 7 shows this composite drilling system as seen from obliquely below, while FIG. 8 shows a single drill tube 9 as seen from obliquely below. At the lower end, a relatively coarse external thread 11 is formed on it, by means of which it can be screwed into a matching internal thread 12 on the next drill pipe 9, as such a pipe is shown in FIG. 9, or by means of which it can be screwed into the lowest pipe, i.e. the initial pipe 8. Seen from above, the hammer drill drive rotates clockwise when drilling, i.e. in the sense of tightening these connecting threads 11, 12. Of course, drilling in the counterclockwise direction is also possible in the same way, but then the threads used would also have to run the other way round.

Figure 10:
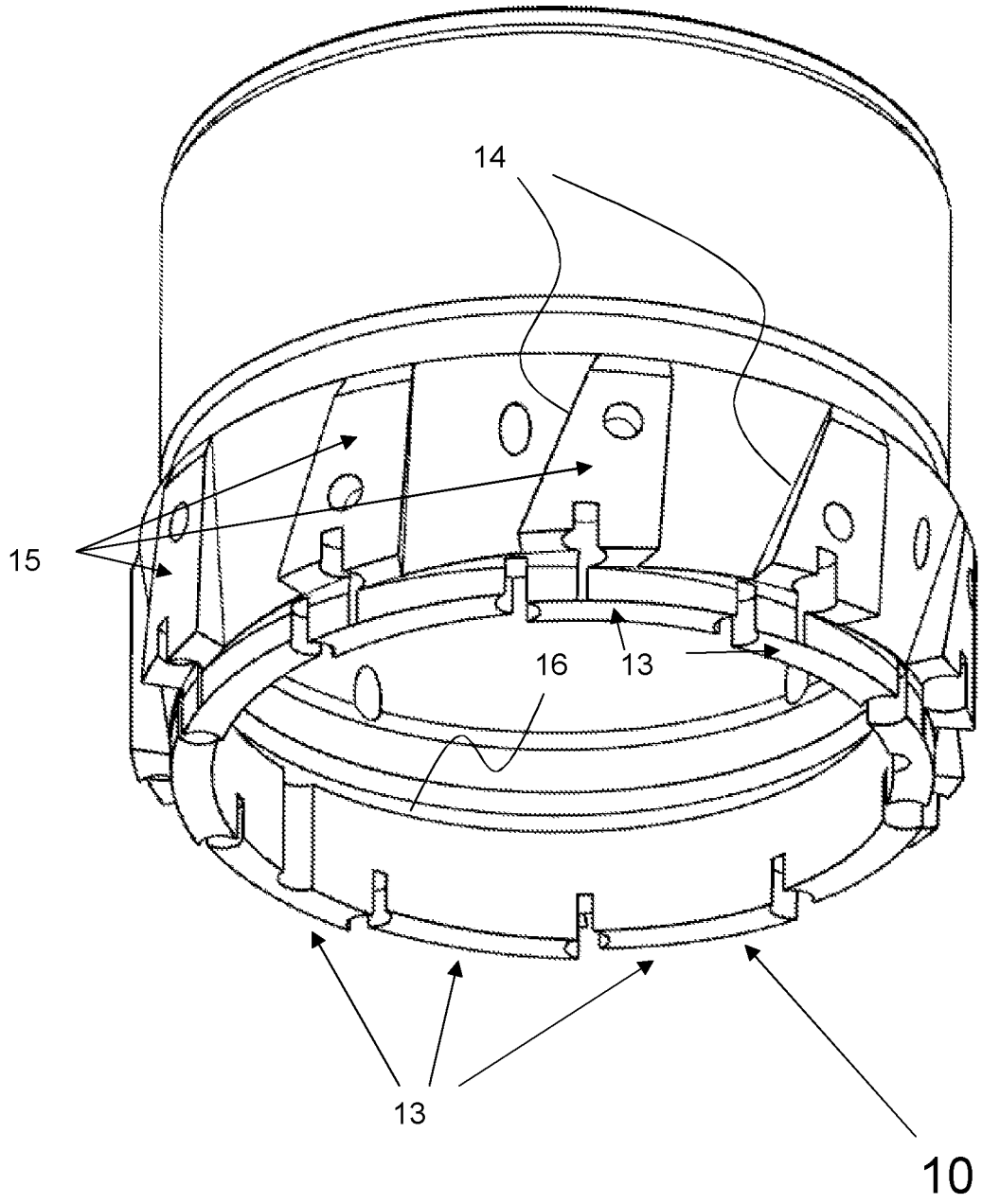
FIG. 10: Enlarged view of the drill bit as seen from below.

Finally, FIG. 10 shows an enlarged view of the drill bit 10 as seen obliquely from below. Drill segments 13 offset with carbide pins are brazed onto the bottom of the drill bits, and lateral outer clearing elements 15 with inclined surfaces 14 provide for clearing upward. The volume of material located axially under the drill bit segments 13 of the drill bit 10, i.e. exactly under the rotating ring formed by the drill bit 10, is injected partly into the drill core and partly into the surrounding ground, and a part is conveyed upwards as overburden on the outside of the drill bit 10 and the initial tube 8 and the drill tube 9. In the lower area of the drill bit 10, a shoulder 16 is formed on the inside as a radially inward projecting projection, on which the sleeve or the drill sample sleeve or the drill core catcher rests, although this is not shown here. This sleeve is flush with the inside of this projection. Thus, as the drill bit 10 progresses, the sinking sleeve or drill core catcher overlaps the exposed drill core and encloses it snugly. It is possible to use other commercially available drill bits, for example diamond bits or otherwise tipped bits.

Starting at the bottom, FIG. 11 shows a sleeve 17 or drill core catcher. Following at the top, one can see the sleeve adapter 21, then the pressure, flushing and recovery tube 19 with its upper pressure, flushing and recovery tube adapter 18, on which the blows of the pile driver act. In the example shown, this pressure, flushing and recovery pipe 19 rotates uniformly with the initial pipe 8 and any inserted drill pipe sections for the drill pipe 9 (FIG. 6).

A very special and highly essential element is the sleeve adapter 21 shown here between the pressure, flushing and recovery pipe 19 and the sleeve 17 or drill core catcher. While the pressure, flushing and recovery pipe 19 rotates and impacts, the sinking sleeve 17 encloses the drill core growing into it during drilling progress without rotation. Only the strong and high-frequency ramming impacts act from the pressure, flushing and recovery pipe 19 on the sleeve 17 and stress this sleeve adapter 21 with enormous force peaks. This adapter must therefore mediate between the rotation of the pressure, flushing and recovery tube 19 and the non-rotating sleeve 17 and, at the same time, on the one hand be able to absorb and permanently withstand enormous impacts at high impact cadence and, on the other hand, convert the rotation of the pressure, flushing and recovery tube 19 into a non-rotating support on the sleeve 17. This cannot be done without sliding friction, and it is therefore clear that large amounts of frictional heat are also generated. It must be possible for this to be thermally absorbed by the sleeve adapter 21, and at the same time the sleeve adapter 21 must be adequately cooled in order to cope with this continuously occurring frictional heat and to dissipate it to the outside.

Figure 12:
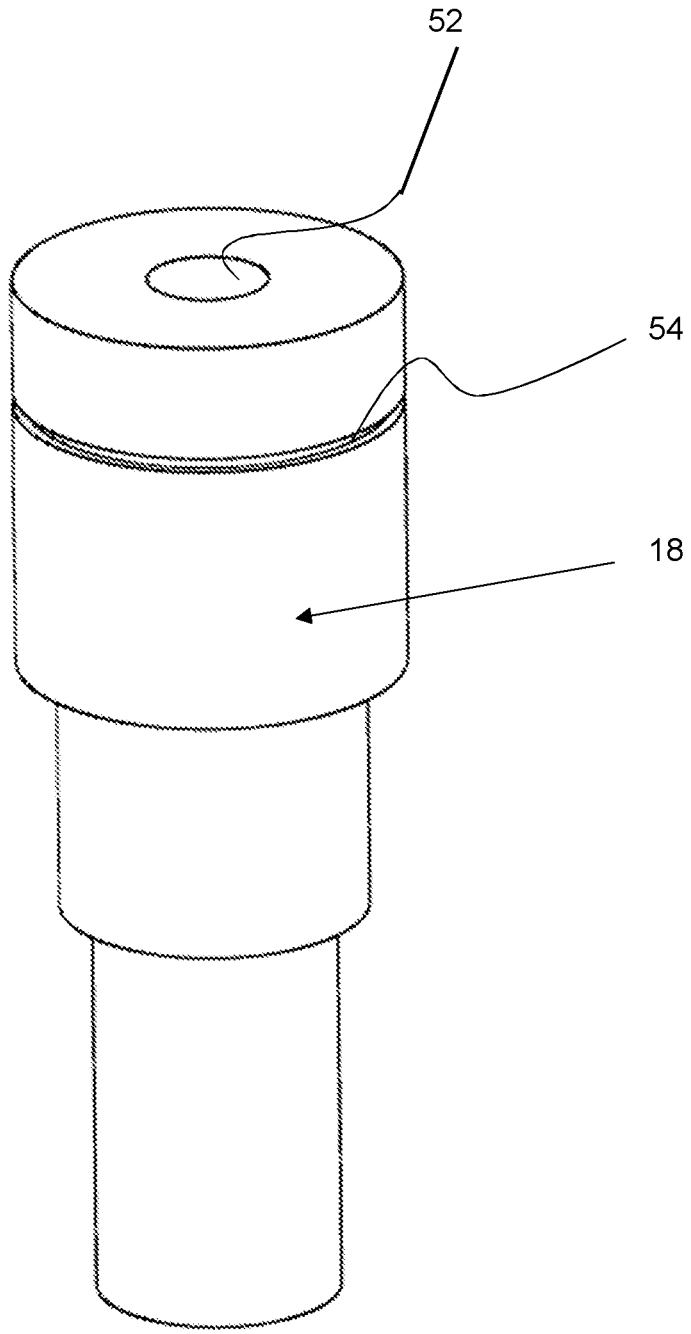
FIG. 12: The PFR adapter to be placed on top of the pressure, flushing and recovery pipe PFR.

FIG. 12 shows an enlarged view of the upper pressure, flushing and recovery tube adapter 18 or PFR adapter of the pressure, flushing and recovery tube 19. Through the axial bore with its inner wall 52, flushing water runs down through the interior of the pressure, flushing and recovery tube 19 and is guided outward within the sleeve adapter 21, to the outside of the initial tube 8. On the pressure, flushing and recovery tube adapter 18, one can see a circumferential annular groove 54, into which an O-ring is inserted, for sealing against the inner wall of the axial bore 37 of the drill head 5.

Figure 13:
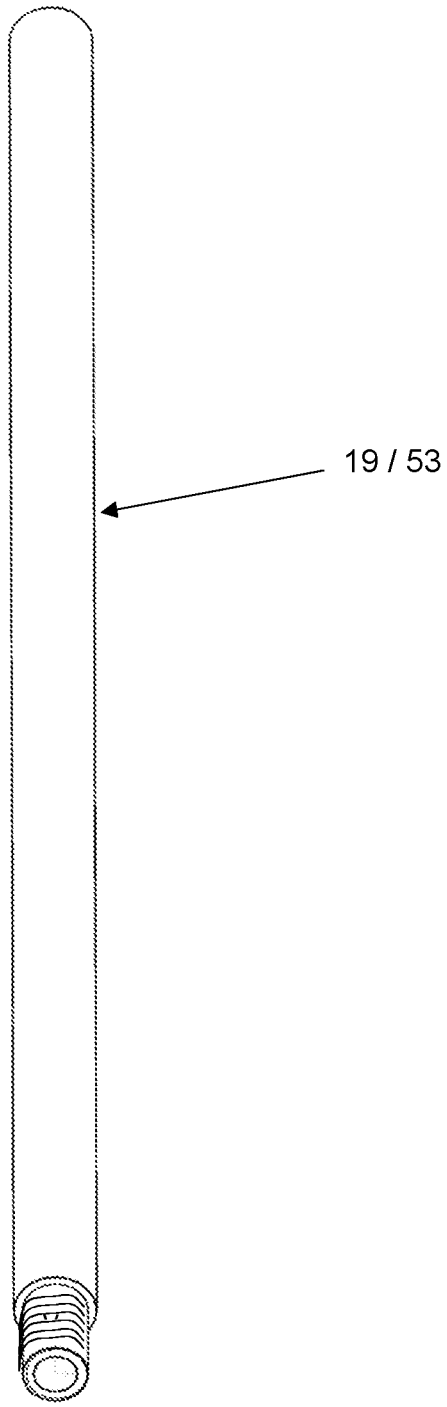
FIG. 13: A pressure, flushing and recovery pipe PFR as an extension piece, seen from below at an angle.

FIG. 13 shows a hollow pressure, flushing and recovery pipe section (PFR) 53 as an extension pipe for the hollow pressure, flushing and recovery pipe 19 as required, which is simply screwed with its lower external thread into the upper, associated internal thread of the pressure, flushing and recovery pipe 19 connected below. The extension tube 53 thus corresponds substantially to the actual pressure, flushing and salvage tube 19, which in the example shown has an internal thread at the top for extending.

Figure 14:
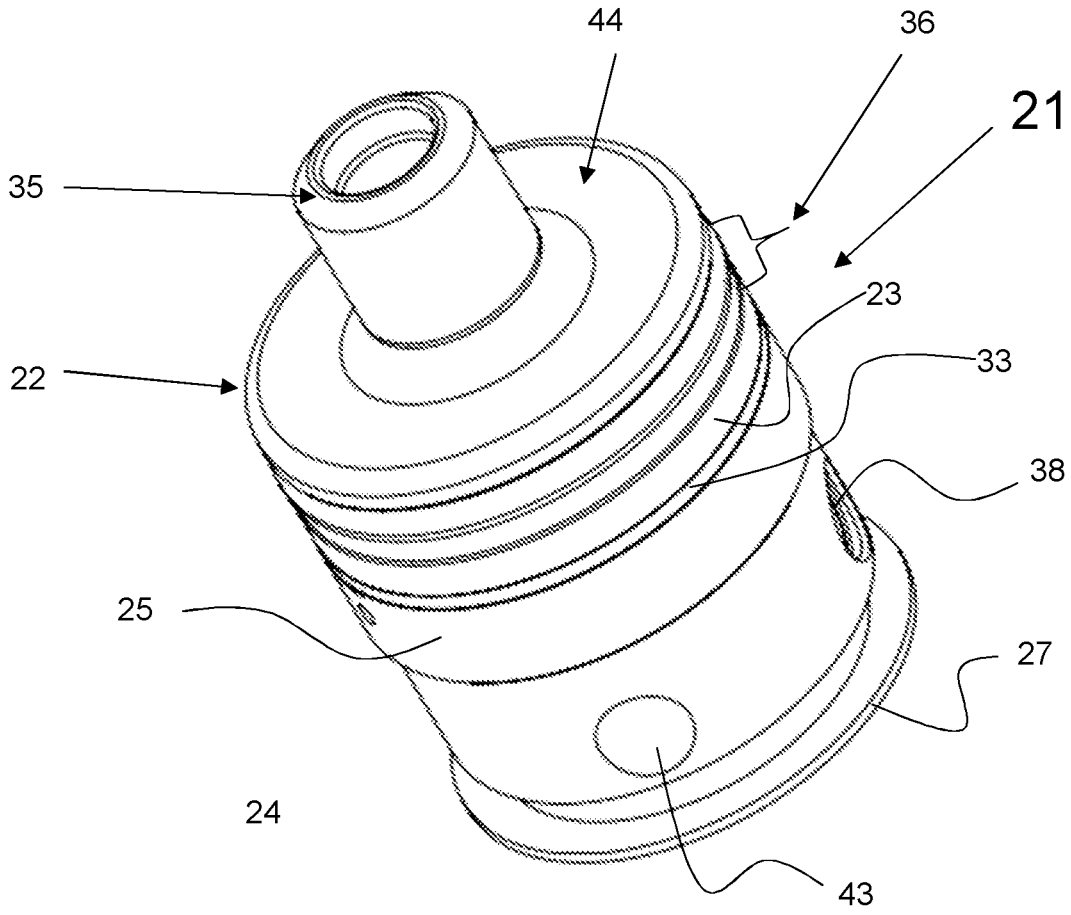
FIG. 14: A sleeve adapter for the impact pressure resistant connection of the sleeve or the drill core catcher to the pressure, flushing and recovery pipe, seen from diagonally above to diagonally below.

In the following, the very essential and particular element of this drilling system will be presented, namely the sleeve adapter 21 which ensures the connection from the PFR 19 to the sleeve 17. For this purpose, FIG. 14 shows this sleeve adapter 21 for the impact pressure resistant connection of the sleeve 17 or the drill core catcher to the pressure, flushing and recovery pipe PFR 19 in a view from obliquely above. At the top, a threaded stub 35 projects from the sleeve adapter 21 and terminates at the bottom in a base body 22 of the sleeve adapter, which base body 22 forms a plate or shoulder 44 at the top. This base body 22, onto whose threaded stub 35 the pressure, flushing and recovery tube 19 is screwed with its lower internal thread, therefore rotates uniformly with the drill pipe 9 and the rotating pressure, flushing and recovery tube 19. Following downwardly is a sealing ring 36, which is preferably made of hard plastic rubber and can rotate along with the base body 22. Between the base body 22 and the stationary receiving ring 23, the rotation of the pressure, flushing and salvage tube 19 is thus absorbed, so that the stationary lower part 24 of the adapter 21 is connected to the sleeve 17 in a pressure-locking but non-rotating manner. Above the visible part of the lower part 24, one sees here a sliding sleeve 25, the significance of which will become clear. The sleeve 17 or the core catcher is pushed over this lower part 24 from below with an exact fit until the upper edge of the sleeve 17 abuts the sliding sleeve 25 at the bottom A pressure ring 33 made of hardened steel is also attached at the bottom of the adapter's receiving ring 23. At the bottom of the lower part 24 of the basic body 22, one can still see a rubber washer 27 projecting slightly radially beyond the lower part 24 for sealing the sleeve adapter 21 with respect to the inner wall of the sleeve 17.

Figure 15:
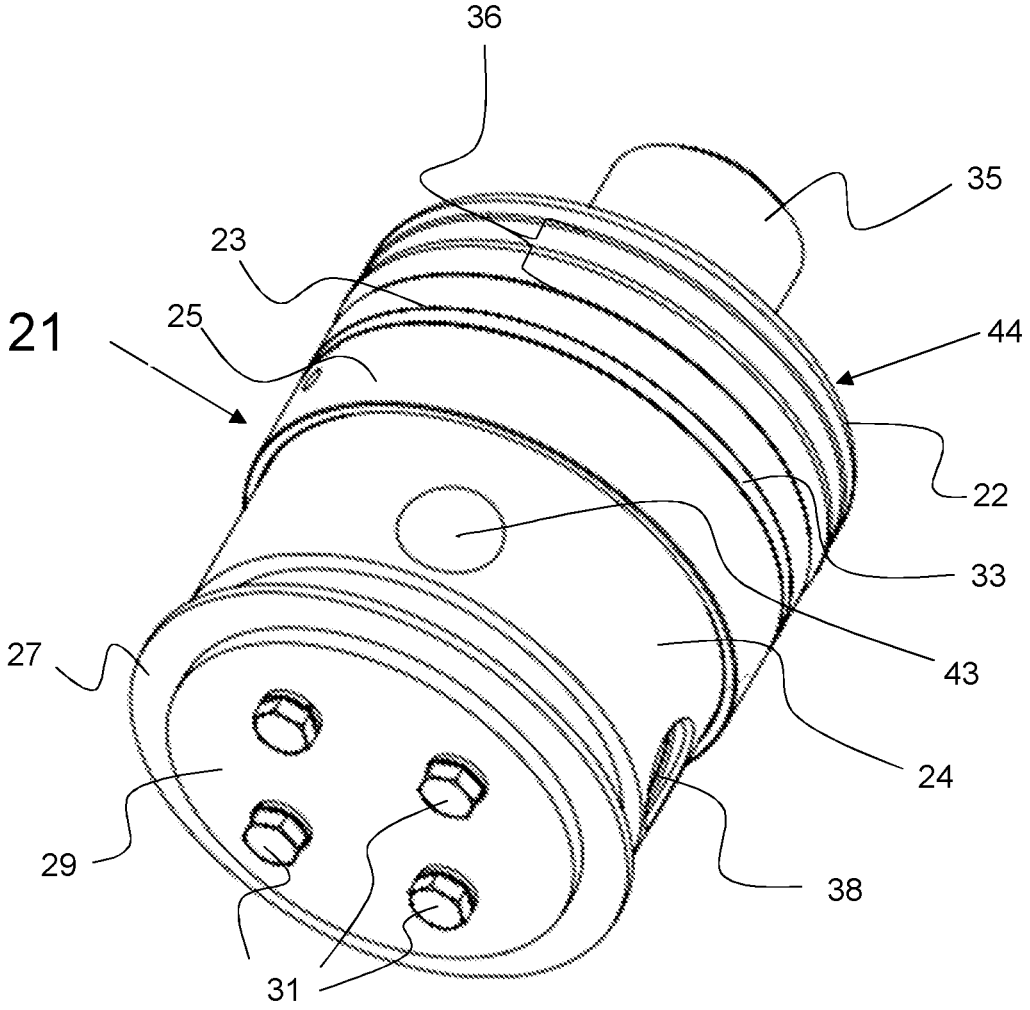
FIG. 15: The sleeve adapter of FIG. 14 for the impact pressure resistant connection of the sleeve or the core catcher to the pressure, flushing and recovery pipe, seen from diagonally below to diagonally above.

In FIG. 15, the sleeve adapter 21 is shown in a view from obliquely below. Here, again from top to bottom, one can see first the threaded stub 35 for screwing on the pressure, flushing and recovery tube 19 from above, then the shoulder 44 of the base body 22 of the sleeve adapter 21, followed first by the plastic hard rubber sealing ring 36, which rests on the receiving ring 23. This is followed by the sliding sleeve 25 and below it can be seen the pressure ring 33 made of hardened steel. The slightly radially projecting rubber washer 27 for sealing the sleeve adapter 21 against the inner wall of the sleeve 17 is clamped to the lower part 24 by a steel washer 29 and here four axial screws 31. One can also see the diametrical bore 43 for the fixing bolt, which then extends through this diametrical bore in the lower part 24, as well as a bore 38 for a locking bolt, as will be clear from the next figures.

Figure 16:
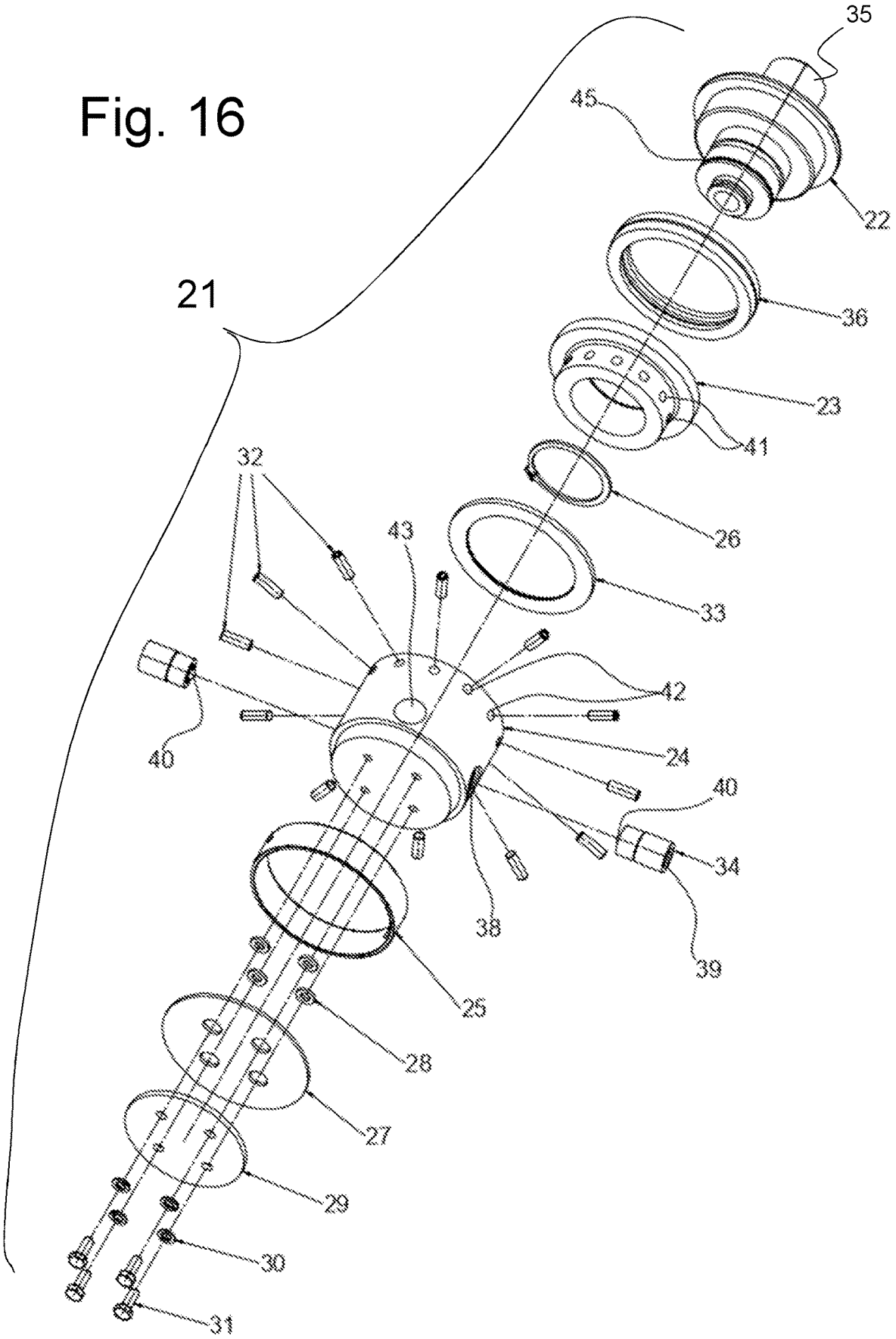
FIG. 16: The individual parts of the sleeve adapter from FIGS. 14 and 15 in a linear exploded view.

The detailed construction of the sleeve adapter 21 can be seen from FIG. 16, which shows this sleeve adapter 21 in an exploded view with explosion of the parts along its central axis. Starting from the top, one can first see the base body 22 of the adapter 21 intended for rotation, followed by the sealing ring 36, the plastic hard rubber ring for sealing against the initial tube 8. This then comes to rest on the receiving ring 23 shown below. This receiving ring 23 is stationary in operation, i.e. does not rotate, and it merges at the bottom into a tapered section and this has radial bores 41 all round into which cylindrical pins 32 fit, which are shown further down to the lower section 24, and whose function will become clear immediately. Below the receiving ring 23, a circlip/Seeger ring 26 is shown as a retaining ring, which comes to rest in the annular groove 45 on the 0base body 22 when assembled. From below, this likewise stationary lower part 24 of the sleeve adapter 21 is pushed over this tapered part of the receiving ring 23, and then the cylindrical pins 32 drawn all around are pressed from the outside into the radial bores 42 on the lower part 24 as well as into the radial bores 41 on the receiving ring 23, which are then aligned therewith, whereby these two parts 23, 24 are connected to each other in a rotationally fixed manner. After insertion of these cylindrical pins 32, the sliding sleeve 25 is slid over this tapered lower part of the receiving ring 23 while covering and thus securing these cylindrical pins 32.

The retaining ring 26 is thereafter inserted into the annular groove 45 at the lower end of the base body 22, so that it is seated on the base body 22 with the locating ring 23 secured in the axial direction. The lower part 24 of the adapter 21 has a diametrical bore 43 for receiving a fixing pin not shown. At right angles to this diametrical bore 43, there are two further radial bores 38 lying on a common axis, into which securing bolts 34 are inserted in order to secure the inserted fixing bolt. These two securing bolts 34 each have a pressure-loaded ball 40 at the front, which engage in a longitudinal groove on the inserted locating bolt and, for example, engage in a recess 56 halfway along the length of the groove, thereby securing it. After being inserted into the bores 38, the fixing bolts 34 are each secured by means of a circlip/Seeger ring 39. Through the axially drilled fixing bolt in the bore 43, the flushing water flowing downward from above through the hollow pressure, flushing and recovery pipe 19 flows outwardly, as will become clear. This flushing water flows first through the sleeve adapter 21 and then radially out of its lower part 24, namely on both sides through the fixing bolt in its axial bore to its end faces and so to the outside. The thrust ring 33 absorbs the axial forces acting on the sliding sleeve 25 and distributes them evenly to the locating ring 23, which is made of aluminum bronze. The rubber washer 27 and the somewhat smaller steel washer 29 are clamped on four washers 28 and by means of the four screws 31 shown and their associated spring washers 30 to secure them to the lower part 24.

Figure 17:
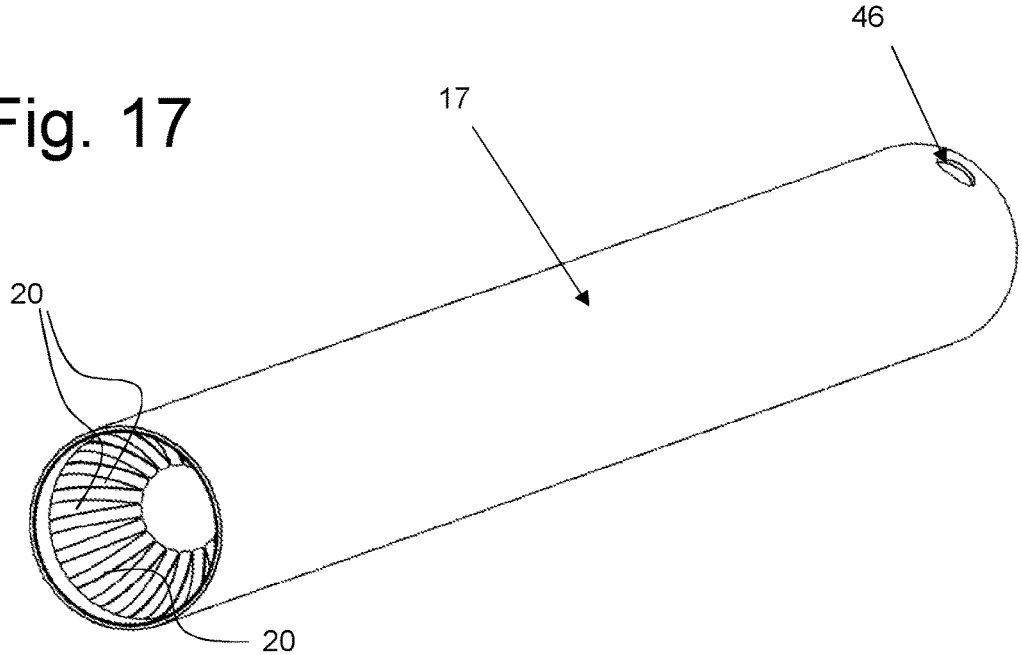
FIG. 17: A sleeve or core catcher seen from diagonally below.

FIG. 17 shows the sleeve 17 or the drill core catcher as viewed from below at an angle. At the lower edge, the sleeve 17 is equipped on its inner side with a number of spring steel elements 20 distributed around its circumference, which here project arcuately upwards and towards the central axis of the sleeve 17. When the sleeve 17, which is subjected to ramming impacts from above in the same manner as the initial tube 8 and the drill bit 10, is inverted from above over a drill core exposed by the drilling progress of the drill bit 10 and the initial tube 8, these spring steel elements 20 are pressed against the inner wall of the sleeve 17 by the drill core and the sleeve 17 is put further over the stationary drill core without rotation, with a purely axial movement, with the spring steel elements 20 applied to its inner side in this manner. When the sleeve 17 is pulled up with the pressure, flushing and recovery tube 19, however, these spring steel elements 20 act as barbs. If the drill core does not develop sufficient adhesive force when the sleeve 17 is pulled up with it, these spring steel elements 20 engage the drill core radially at the slightest slip of the sleeve 17 on the drill core, bend towards the central axis of the sleeve 17 and form a catch basket for the drill core so that it is held securely in the sleeve 17 and is prevented from slipping out downwards, i.e. core loss in the loose rock is reliably prevented. At the upper edge region of the sleeve 17, one can see a radial bore 46 for the flushing water coming out of the sleeve adapter 21.

Figure 18:
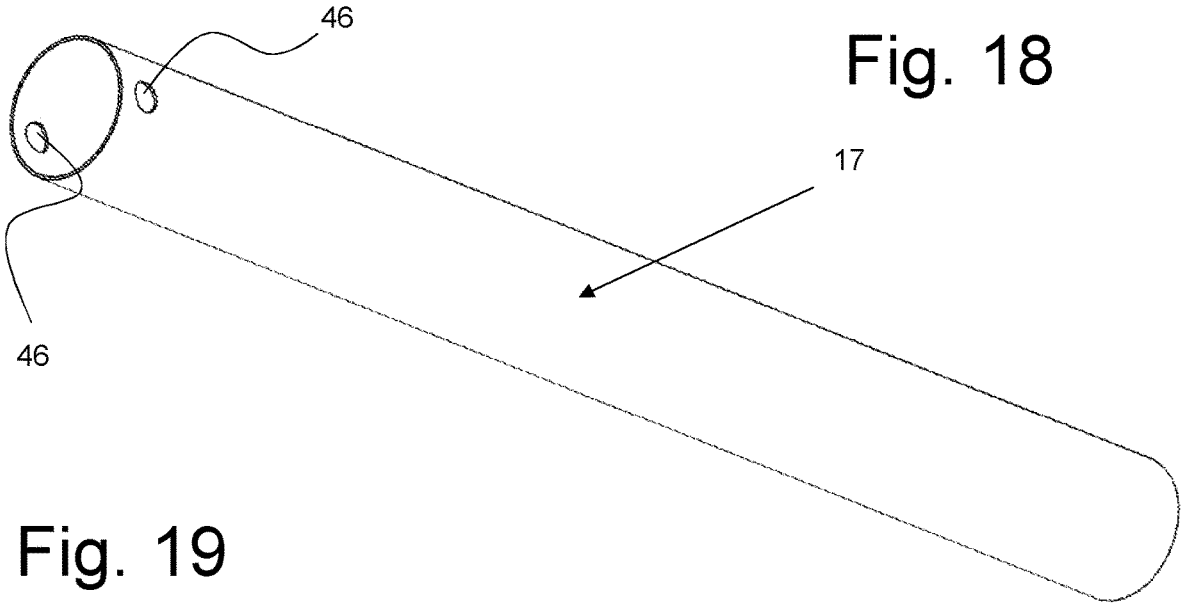
FIG. 18: A sleeve or core catcher seen from above at an angle.

FIG. 18 shows the sleeve 17 or the drill core catcher as seen from above at an angle, and here it can be seen that there are two diametrically aligned holes 46 made in the upper edge region in the sleeve 17. When the sleeve 17 is slipped over the lower part 24 of the sleeve adapter 21, these two bores 46 come to lie above the radial bores 43 in the lower part 24, so that the flushing water, which flows out of the end faces of the fixing pin inserted there, finally penetrates from the inside of the adapter 21 to the outside, and through these aligned bores 46 in the upper region of the sleeve 17 to the very outside. This flushing water performs several functions. First, it cools the sleeve adapter 21, which is heated due to the sliding friction between the rotating base body 22, the plastic-hard-rubber sliding ring 36 and the stationary receiving ring 23 and lower part 24, and also due to the ramming impacts. Further, it lubricates between the outside of the non-rotating sleeve 17 and the inside of the initial tube 8 rotating around the sleeve, and finally it conveys debris from below the drill bit 10 radially outward and subsequently upward on the outside of the initial tube 8. This continuously flushes the borehole and also lubricates and cools the outside of the initial pipe 8. Depending on the conditions, however, it is also possible to drill dry.

Figure 19:
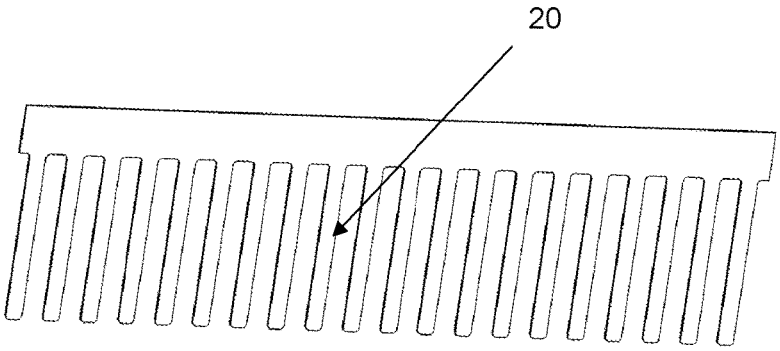
FIG. 19: A rolled-out spring retainer in the sleeve for retaining the core.

FIG. 19 shows an insert unrolled in the relaxed state with spring steel elements 20, which here form a comb, as it were. This comb is rolled longitudinally and then inserted into the bottom of the sleeve 17, where it rests on an inner shoulder 58, as can be seen in FIG. 17.

Thus, the individual parts of the drilling system are disclosed and described. Now, how does drilling and recovering a drill core from loose ground work with this drilling system? For this purpose, the whole procedure is explained by means of a sequence of figures, for example, as shown in FIGS. 20 to 36.

Figure 20:
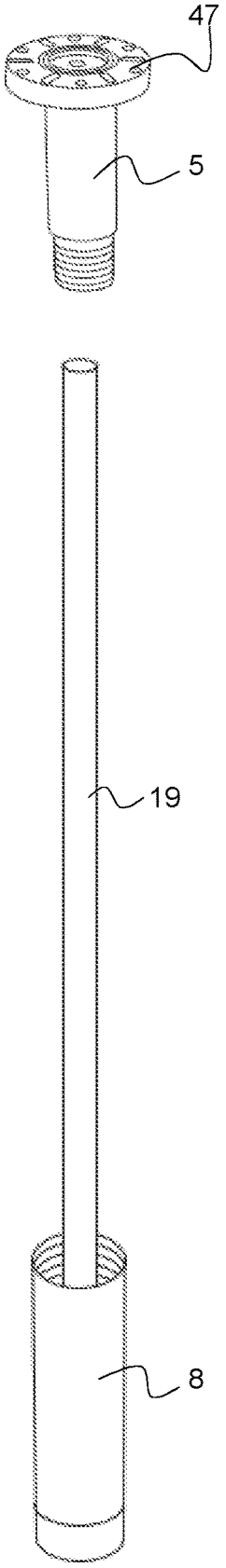
FIG. 20: The drill head above, the pressure, flushing and recovery pipe below with the initial pipe below, in which the sleeve is inserted, before its removal from the initial pipe.
Figure 21:
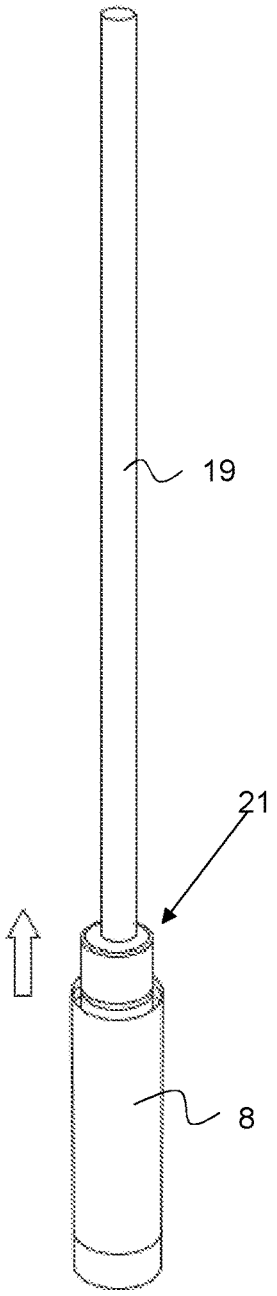
FIG. 21: The pressure, flushing and recovery pipe at its pulling upwards to remove the sleeve or the core catcher from the initial pipe.
Figure 22:
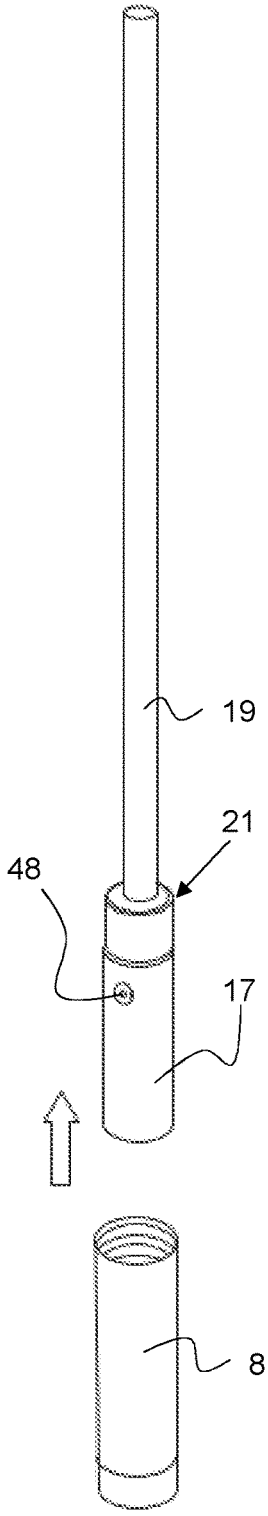
FIG. 22: The pressure, flushing and recovery tube after the sleeve or core catcher has been pulled upwards out of the initial tube.

FIG. 20 first shows at the bottom the exposed initial tube 8 with the sleeve 17 therein and the hollow pressure, flushing and recovery tube 19 screwed thereon by means of the sleeve adapter 21. Shown above this is the drill head 5, which here is set in rotation by the hydraulic drill drive of the hammer drill 2 via a flange 47. Between this drill head 5 and the lowest section, the initial pipe 8, drill pipe sections can be inserted as required as extension pipes for the drill pipe 9, depending on the desired drilling depth. The drill head 5 is screwed directly onto the initial tube 8 at the beginning. Then drilling is carried out until the initial tube 8 is almost drilled into the bottom. Then the drill head 5 is unscrewed from the initial tube 8 by a counter rotation. When the initial pipe 8, when it is in the ground, is exposed as shown here, i.e. the drill head 5 with the drive flange 47 removed, the pressure, flushing and recovery pipe 19 with the sleeve 17 hanging from it at the bottom can be pulled axially upwards out of the initial pipe 8, as shown in FIG. 21, where the sleeve adapter 21 is just revealed. In FIG. 22, the adapter 21 has been completely pulled out of the initial tube 8 by the pressure, flushing and recovery tube 19 together with the sleeve 17 or drill core catcher hanging from it. Here one can see a face of the fixing bolt 48, which holds the sleeve 17 securely to the sleeve adapter 21. In this condition, the sleeve 17 is pulled up out of the initial tube 8 by means of the pressure, flushing and recovery tube 19, until finally reaching the surface.

Figure 23:
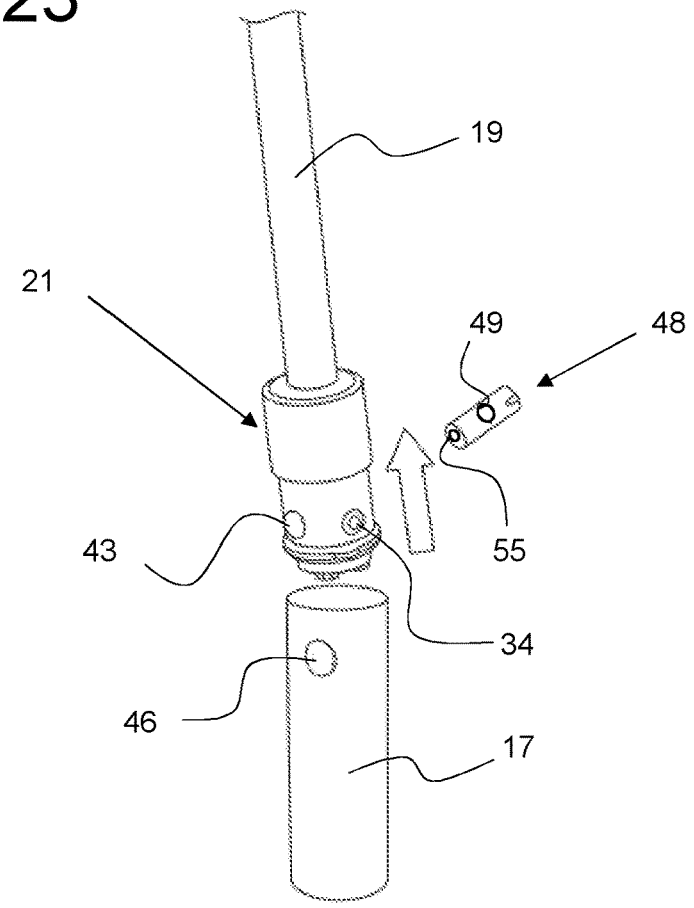
FIG. 23: The sleeve adapter pulled out of the sleeve at the bottom of the pressure, flushing and recovery tube.

Once at the surface, as shown in FIG. 23, the fixing bolt 48 is knocked out or pulled out or pushed out of the bore 43 in the lower part 24 of the sleeve adapter 21, as has already been done in the view shown. Only the empty diametrical bore 43 in the lower part 24 of the sleeve adapter 21 is visible here. Locking pins 34 are inserted in two bores 38 made at right angles to the bore 43, which have a ball 40 at the front that is pressurized by means of a compression spring, as can be seen in FIG. 16. The fixing bolt 48 is driven out of the diametrical bore 43 against the resistance of these pressure-loaded balls 40 at the front of the securing bolts 34, as is clear from FIG. 24.

Figure 24:
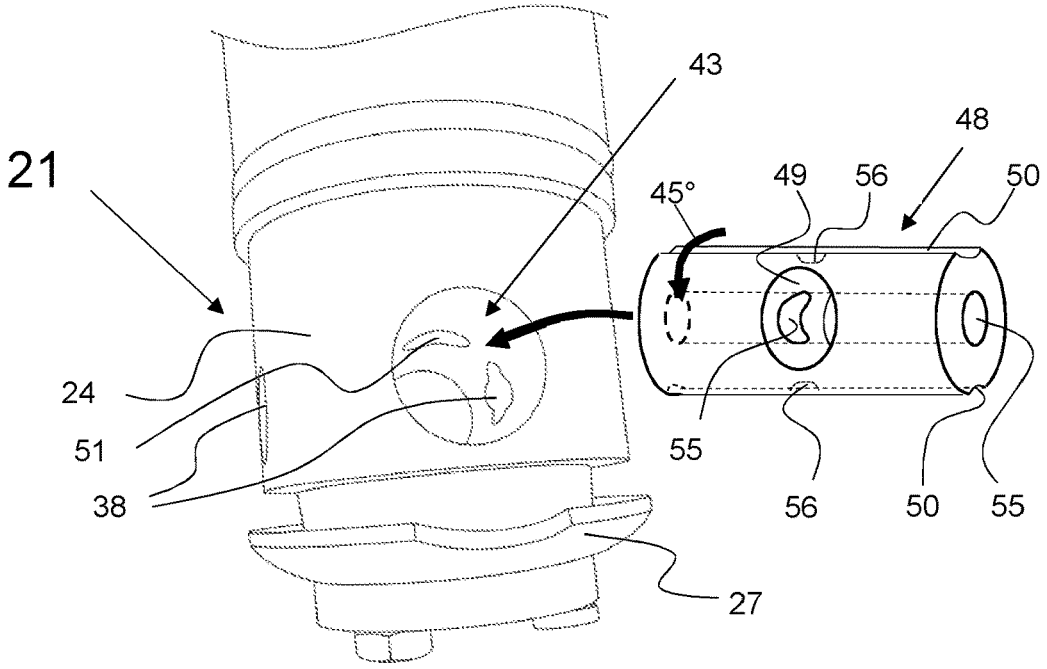
FIG. 24: The lower part of the sleeve adapter shown enlarged, with a view into the bore for the fixing bolt as well as the fixing bolt next to it.

FIG. 24 shows the lower part 24 of the sleeve adapter 21 enlarged to look into the diametrical bore 43 for the fixing bolt 48, which is shown separately next to it. However, in order to be inserted into the lower part 24 of the sleeve adapter 21, this must first be rotated by 45° about its longitudinal axis, as indicated by an arrow. From this locating pin 48, on two opposite sides, are recessed longitudinal grooves 50 in the shape of a channel, the bottom of the groove of which here has a curved recess 56 halfway over the locating pin 48. These spring-loaded balls 40 (FIG. 16) of the securing bolts 34 fit into these recesses 56 and only when the fixing bolt 48 receives a sufficiently strong blow in the longitudinal direction is it able to overcome their securing by pushing back the spring-loaded balls 40 and can then be pushed or pulled out of the bore 43 while its longitudinal grooves 50 slide outward past the balls 40. As can be seen here, a central transverse bore 49 is formed in the locating pin 48 which communicates with an axial bore 55. These bores 49, 55 serve to guide the flushing water, which passes in the sleeve adapter 21 from above through the axial bore 51 through the transverse bore 49 into the fixing bolt 48 and is thereafter guided in the latter along the axial bore 55 outwardly from its end faces. On the sleeve 17 in FIG. 25, you can still see one of the holes 46 in which the locating pin 48 previously engaged and held it, through which the flushing water exits.

After the sleeve 17 or the drill core catcher has been brought into a horizontal position at the surface and the drill core lying therein has been carefully pushed out of the sleeve 17 mechanically or hydraulically with a piston onto a jug-shaped drill core carrier, this drill core is present almost undisturbed. The empty sleeve 17 can be immediately reinserted for removal of a next drill core, or a ready empty sleeve 17 can be immediately reinserted. In one variant, a liner can be inserted into the sleeve 17, which then lines the inside of the sleeve 17 and into which a drill core grows. In this case, the recovered drill core together with the liner is pushed out of the sleeve 17 and then lies absolutely intact like a sausage. Individual slices can be cut off in tranches in order to examine the structure of the drill core and how this changes along its entire length. If in the process a sleeve 17 is brought to the surface together with the drill core, then after the sleeve 17 has been separated from the sleeve adapter 21, an empty sleeve 17 can immediately and without any delay be connected to the sleeve adapter 21 and this can immediately be lowered again into the initial tube 8 in the borehole and thus drilling can continue without necessitating an interruption of the drilling work as a result of the removal of the drill core from the recovered sleeve 17.

Figure 25:
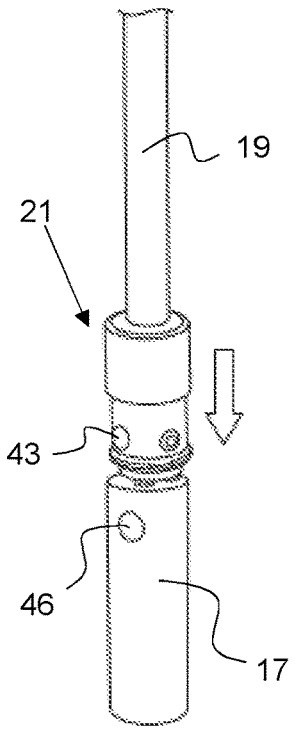
FIG. 25: The pressure, flushing and recovery tube with sleeve adapter during connection of an empty or emptied sleeve.
Figure 26:
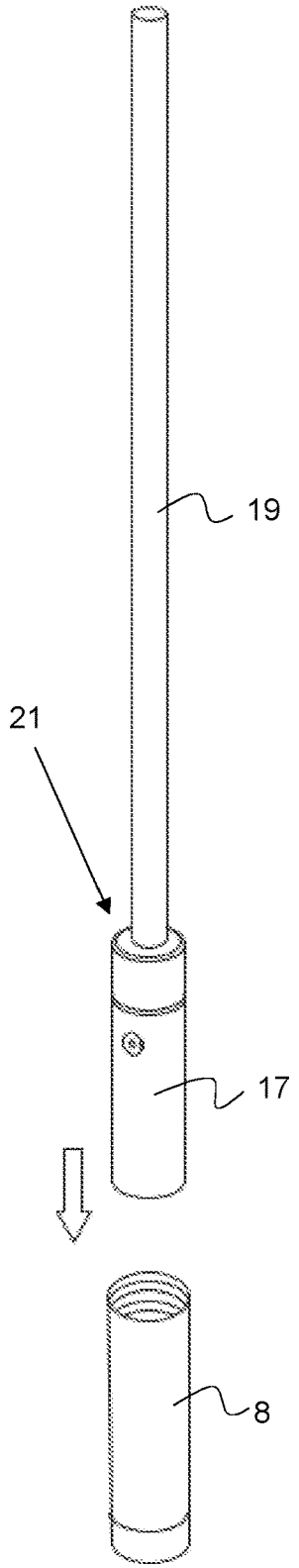
FIG. 26: The pressure, flushing and recovery tube with sleeve adapter and empty sleeve before insertion into the initial tube.
Figure 27:
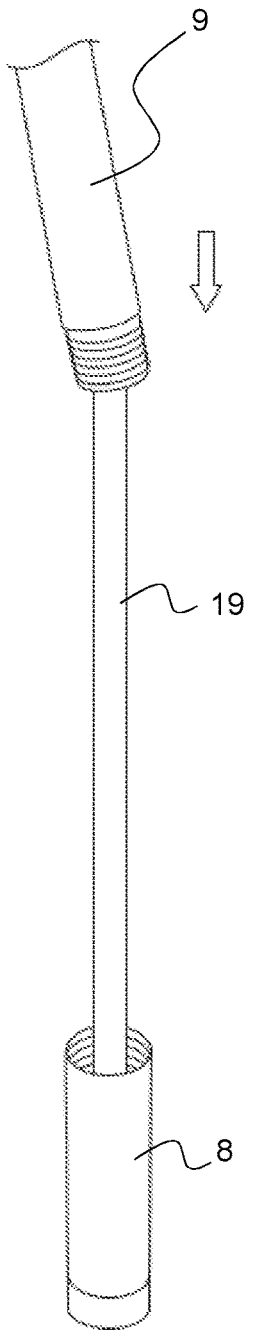
FIG. 27: The pressure, flushing and recovery pipe with sleeve adapter and empty sleeve inserted into the initial pipe, when placing a drill pipe on the initial pipe.
Figure 28:
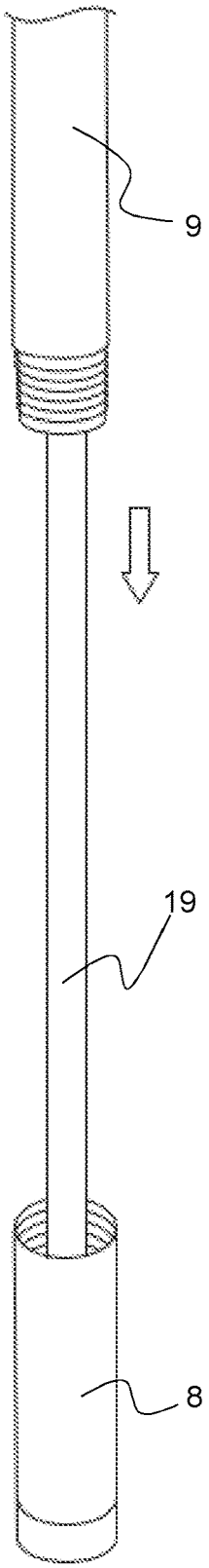
FIG. 28: The downward movement of a drill pipe over the pressure, flushing and recovery pipe onto the initial pipe.
Figure 29:
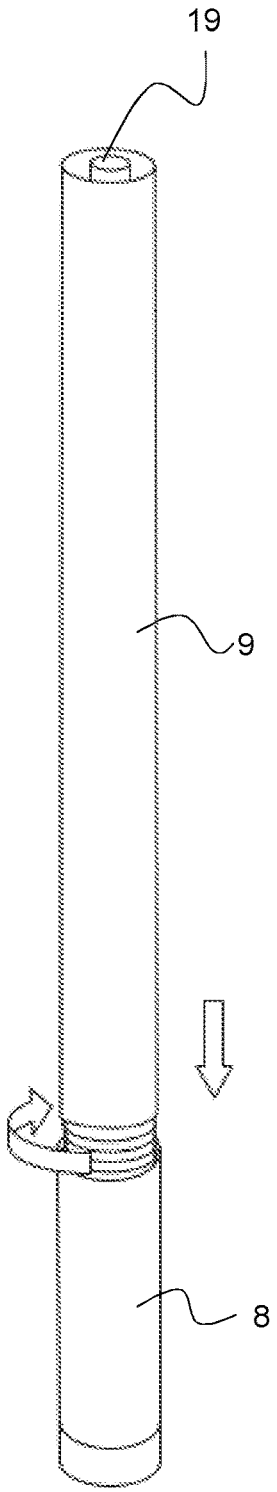
FIG. 29: Screwing a drill pipe onto the initial pipe.
Figure 30:
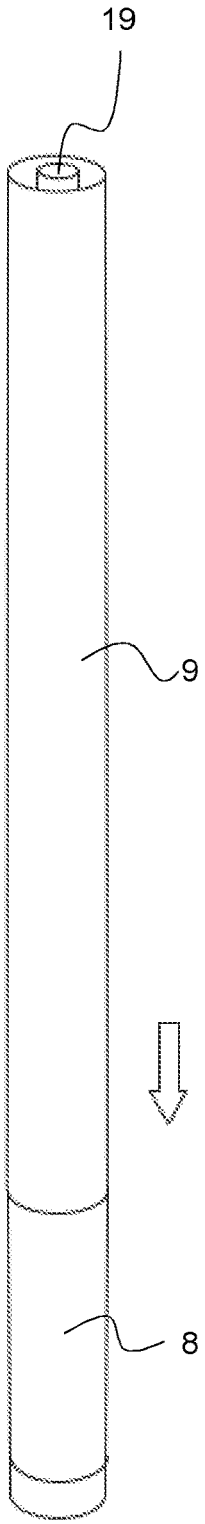
FIG. 30: A drill pipe ready screwed onto the initial pipe.
Figure 31:
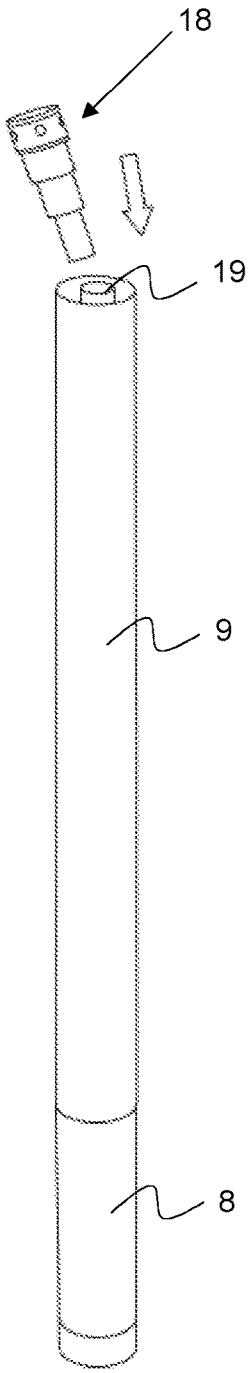
FIG. 31: The PFR adapter at the top of the pressure, flush and recovery pipe being placed on the top of the pressure, flush and recovery pipe.
Figure 32:
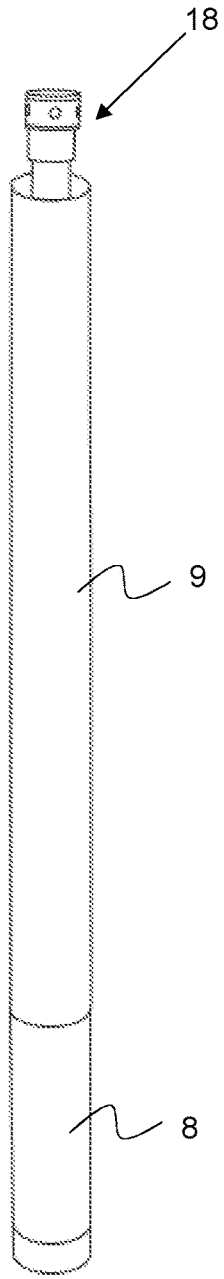
FIG. 32: The PFR adaptor of the pressure, flushing and recovery pipe ready mounted.
Figure 33:
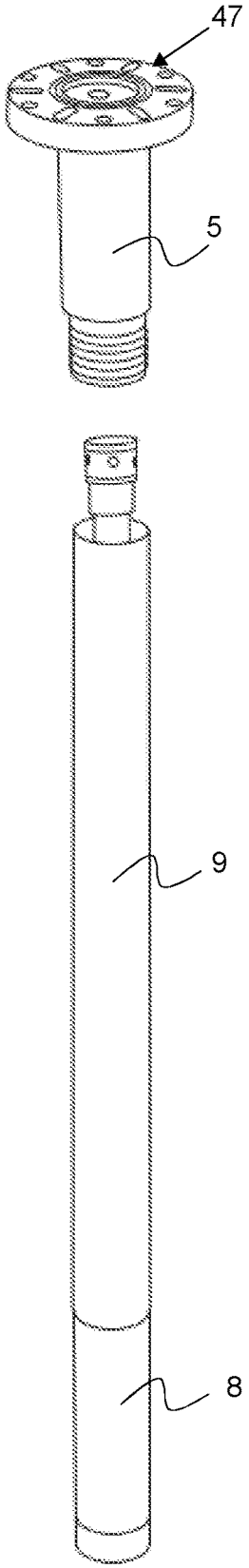
FIG. 33: The drill head above the top end of the pressure, flush and recovery pipe and the top drill pipe.
Figure 34:
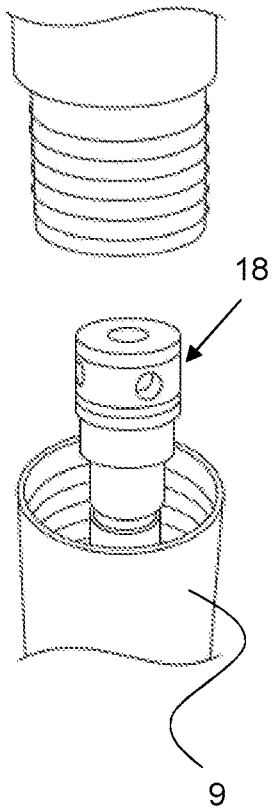
FIG. 34: Enlarged view of the lower threaded section of the drill head and the PFR adapter with the pressure, flushing and recovery pipe connected at the bottom inside the drill pipe.
Figure 35:
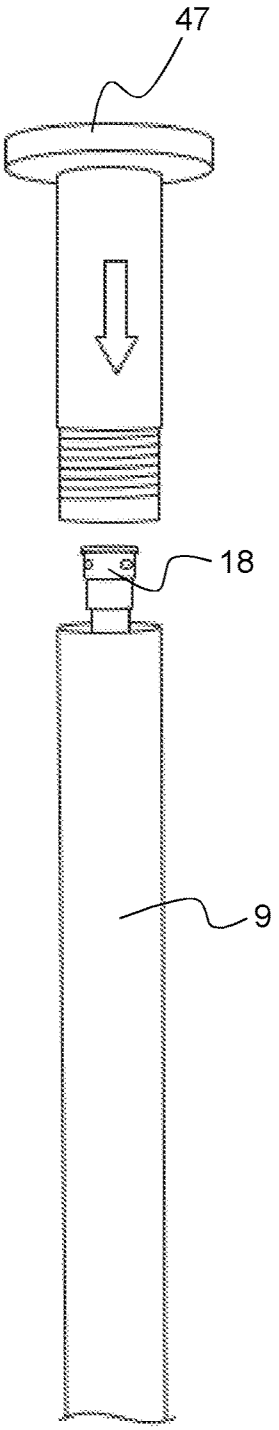
FIG. 35: The drill head with drive flange being lowered over the upper end of the pressure, flushing and recovery pipe for screwing onto the drill pipe.
Figure 36:
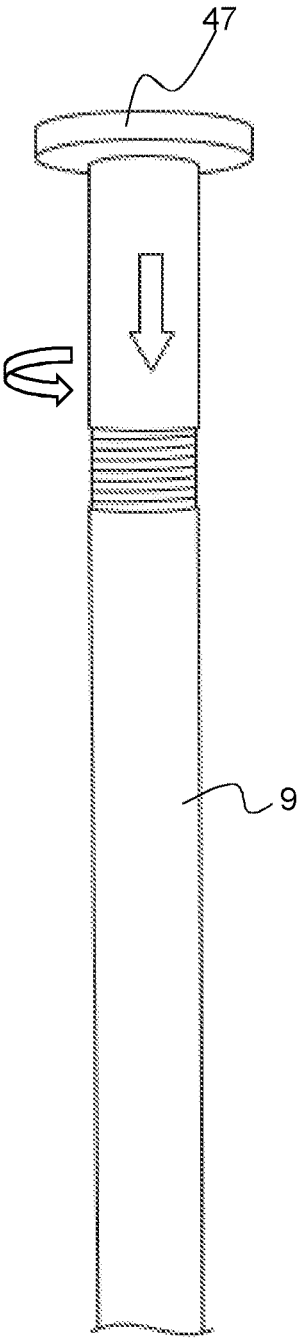
FIG. 36: The drill head with the drive flange being screwed onto the drill pipe.

FIG. 25 shows how the sleeve adapter 21 is connected to an empty sleeve 17 by being lowered into it, and when the hole 43 on the sleeve adapter 21 is aligned with the hole 46 on the sleeve 17, the locating pin 48 can be inserted and the sleeve 17 is ready to be lowered into the initial pipe 8 with the pressure, flushing and recovery pipe 19. This lowering is shown in FIG. 26. As soon as the sleeve 17 is fully inserted into the initial tube 8, i.e. is in contact with the bottom of the drill bit 10, the next step follows as shown in FIG. 27. A drill pipe 9 is slipped over the pressure, flushing and recovery pipe 19 as an extension pipe and lowered onto the bottom of the initial pipe 8, as shown in FIG. 28, and then screwed onto the initial pipe 8, as shown in FIG. 29. After screwing, the situation is as shown in FIG. 30. Finally, the pressure, flushing and recovery pipe adapter 18 of the pressure, flushing and recovery pipe 19 is first fitted or screwed on, as shown in FIG. 31, and then, from the situation as shown in FIG. 32, the drill head 5 with the drive flange 47 is screwed on, as shown in FIG. 33. The details of this are shown in FIGS. 34 to 36.

As can be seen from this description and the figures, the pressure, flushing and recovery pipe 19 is rightly named. Initially, it rotates uniformly with the drill pipe 9 or initial pipe 8 during drilling, and the sleeve adapter 21 at its lower end provides the mediation to the stationary sleeve 17 or drill core catcher. The hard ramming impacts on the pressure, flushing and recovery tube 19 are reliably and directly transmitted by the sleeve adapter 21 to the sleeve 17 or the drill core catcher. The latter is thus pressed down with the same pressure as the drill bit 10, which ensures the continuous sinking of the sleeve 17 over the exposed drill core. The pressure, flushing and recovery pipe 19 thus firstly fulfills a pressure function. During drilling, flushing water can be pumped down through the pressure, flushing and recovery pipe 19 and this is directed outward through the sleeve adapter 21, i.e. first axially through the pressure, flushing and recovery pipe 19, then axially through the sleeve adapter 21 and finally radially, i.e. in the axial direction through the diametrically inserted fixing bolt 48 on its two end faces and then outward through the bore 46 on the sleeve 17. The pressure, flushing and recovery tube 19 therefore secondly also has a flushing function. When it is necessary to recover the filled sleeve 17 with the drill core trapped therein, the sleeve 17 with the drill core therein is recovered with the aid of the pressure, flushing and recovery tube 19 after the drill head 5 has been loosened. Therefore, thirdly, the pressure, flushing and recovery tube 19 also has a recovery function. It integrally combines these three important functions.

In the embodiment described so far, the pressure, flushing and recovery tube 19 rotates with the drill head 5 and the drill pipe 9, and the sleeve adapter 21 conveys to the non-rotating or rotating sleeve 17 by having two axially successive parts which are rotatable relative to each other. Between the axially successive parts there is preferably arranged a sealing ring 36 made of plastic hard rubber. If now, in an alternative embodiment, a rotary disc body constructed similarly to this sleeve adapter—henceforth referred to as a drill head adapter—is screwed at the top with its threaded stub into the bore in the drill head 5, which has an internal thread for this purpose, the upper part of this rotary disc body or drill head adapter rotates along with the drill head 5, while the lower part, which is rotatable relative to the upper part, remains stationary. It is connected to the now upper end of the rotary, flushing and recovery pipe 19 in the same way as the already presented lower part of the sleeve adapter 21, with a fixing bolt, which then, however, does not require an axial bore, but only a transverse bore for allowing the flushing water to pass downward. At the bottom, the pressure, flushing and recovery pipe 19 is then screwed to only a lower part of a sleeve adapter 21, for which purpose this lower part forms a threaded butt at the top and the rotary, flushing and recovery pipe 19 has an associated internal thread at the bottom. The lower part of the sleeve adapter 21 is connected to the sleeve 17 by the fixing bolt 48 with its axial bore 55, as already presented. As before, the flushing is effected from the drill head 5 through the pressure, flushing and recovery tube 19 and the lower part of the sleeve adapter 21 and then outwardly through the fixing bolt 48. In this alternative embodiment, too, the pressure, flushing and recovery tube 19 performs the three functions mentioned above, namely, first, exerting pressure on the sleeve 17, second, flushing and thus cooling it, and third, recovering the sleeve 17 when it is filled, that is, pulling it upward to daylight. And despite the fact that the pressure, flushing and recovery pipe 19 in this embodiment remains without rotation, should the sleeve 17 rotate a few angular degrees in the course of sinking over a drill core, it can rotate along with it and the drill head adapter as a rotary disk body at the top with its two parts axially following one another and rotatable relative to one another conveys in this case to the rotating drill head 5.

With the method according to the invention for core drilling in loose to solid ground and for taking drilling or soil samples from the same, as well as the device according to the invention for carrying out this method, almost undisturbed drilling or soil samples can be taken, which enables an optimal evaluation and analysis of their contents.

LIST OF NUMBERS

1 Output shaft of the hammer drill
2 Hydraulic drill drive of the hammer drill
3 Thread on the output shaft 1
4 Drilling system
5 Drill head
6 Axial bore at drill head
7 Radial bore at drill head (venting)
8 Initial tube
9 Drill pipe, extension for drill pipe
10 Drill bit
11 External thread at bottom of drill pipe/extension pipe 9
12 Internal thread at top of drill tube/extension tube 9
13 Drill bit segments tipped with tungsten carbide
14 Bevelled surface on overburden elements 15
15 Stripping elements
16 Heel, radial projection
17 Sleeve, drill core catcher
18 Pressure, flushing and recovery pipe adapter
19 Pressure, flushing and recovery pipe
20 Spring steel elements at lower inner edge of core catcher 17
21 Sleeve adapter between pressure, flushing and recovery tube and sleeve/drill core catcher 17
22 Base body at top to sleeve adapter 21
23 Locating ring to sleeve adapter 21
24 Lower part to sleeve adapter 21
25 Sliding sleeve to sleeve adapter 21
26 Circlip, preferably DIN 471-65×2.5
27 Bottom rubber washer for sleeve adapter 21
28 Washer for sleeve adapter 21
29 Steel washer at bottom of sleeve adapter 21
30 Spring washers, preferably DIN 128-A8
31 Screw, preferably hexagon screw with thread to head ISO 4017-M8×20
32 Parallel pin, preferably NW 8×25 mm with internal thread M5
33 Thrust ring to sleeve adapter 21
34 Locking bolt with pressure ball 40
35 Threaded stub on top of sleeve adapter 21
36 Upper sealing ring, preferably made of plastic hard rubber
37 Axial bore in drill head 5
38 Hole for locking bolt 34
39 Circlip/Seeger ring for locking bolt 34
40 Pressure-loaded ball at front of locking bolt 34
41 Radial bores all around on stationary locating ring 23 of sleeve adapter 21
42 Radial bores all around on stationary lower part 24 of sleeve adapter 21
43 Hole on stationary lower part for fixing bolt 48
44 Shoulder at the top of the base body 22 of the sleeve adapter 21
45 Annular groove at the bottom of the base body 22
46 Diametrical hole at top of sleeve 17
47 Drive flange on drill head 5
48 Fixing bolt in lower part 24 of sleeve adapter 21
49 Transverse hole in fixing bolt 48
50 Longitudinal groove in fixing bolt 48
51 Axial bore in lower part 24 of sleeve adapter 21 for flushing water
52 Inner wall of axial bore in pressure, flushing and recovery adapter 18
53 Pressure, flushing and salvage pipe section as extension pipe
54 Groove for O-ring on pressure, flushing and salvage pipe adapter 18
55 Axial hole in fixing bolt 48
56 Recess halfway along longitudinal groove 50

The invention claimed is:

1. A method for core drilling in ground and for taking samples from the same, comprising: drilling an initial tube into the ground by means of a drilling system with the initial tube and drill bit fastened thereto at a bottom end, and with, at the back end of the initial tube, an attachable drill tube consisting of one or more drill tube sections; rotating and superimposed ramming a drivable drill head, wherein within the initial tube and the drill tube, a sleeve travels axially with the initial tube and the drill tube, wherein a) the initial tube with the drill bit arranged at the bottom end is drilled into the ground in a rotating and hammering manner by means of the drivable drill head which can be subjected to hammering impacts, while the sleeve in the initial tube is held without rotation as a result of a drill core growing relatively into the sleeve and the sleeve is pressed down from above by a pressure, flushing and recovery tube, so that the sleeve moves downwardly in the axial direction with the initial tube and the drill tube growing the drill core into an interior of the sleeve, wherein the pressure, flushing and recovery tube either rotates along with the initial tube and the drill tube and pressurizes the non-rotating sleeve via a sleeve adapter at a lower end of the pressure, flushing and recovery tube, the sleeve-adapter having parts which can be rotated relative to one another, or a rotary disc body as the drill head adapter rotating along a top end of the pressure, flushing and recovery tube and the rotary disc body is connected with the top end to the rotating drill head, and a lower stationary end of the rotary disc body is connected to the pressure, flushing and recovery tube, while the pressure, flushing and recovery tube is non-rotationary, which pressurizes the non-rotating sleeve via the top end of the pressure, flushing and recovery tube;

b) after the sleeve has been filled by the growing drill core, the drill head is detached from the initial tube and, by unscrewing any drill tube still above the bottom above the initial tube, the pressure, flushing and recovery tube is exposed and is pulled out of the initial tube together with the sleeve and the sleeve is detached from the pressure, flushing and recovery tube.

2. The method according to claim 1, wherein after step b)

c) an empty sleeve is connected at the bottom to the pressure, flushing and recovery tube and the empty sleeve is lowered into the initial tube and, depending on the drilling depth, one or more sections of the pressure, flushing and recovery tube are inserted as extension tubes and, correspondingly, one or more drill tube sections for the drill tube are inserted and coupled to the drill head, d) drilling is continued until the sleeve is filled, whereupon step b) is repeated, and wherein, in parallel or with a time delay to these processes, the drill cores are ejected from the recovered casings in the horizontal position of the recovered casings mechanically, hydraulically or pneumatically into suitable horizontal tubular sections.

3. The method according to claim 1, wherein at a lower end of the sleeve, spring steel elements initially directed into the interior of a lower mouth area of the sleeve towards a center of the sleeve are swung up by a drilling sample being turned over and growing into the sleeve when the sleeve is lowered, and which the spring steel elements retain the drilling core in the sleeve when the sleeve is pulled out.

4. The method according to claim 1, wherein no fixing rod is installed to retain the sleeve.

5. The method according to claim 1, wherein the initial tube and the pressure, flushing and recovery tube are connected and disconnected by screwing and unscrewing the drill head mechanically driven by a rotary drive.

6. A device for carrying out the method of claim 1, having a rotary drive with a rotatable drilling head which can be subjected to impacts from above by means of a pile driver and the torque of which can be transmitted to an initial tube with a drill bit arranged at the end and to a possible drill tube consisting of one or more drill tube sections connected to the back end of the initial tube, wherein inside the initial tube, a sleeve and a pressure, flushing and recovery tube connected thereto, is connected in a pressure-locking and traction-locking manner to the rotating drill head, whereby the pressure, flushing and recovery tube is connected to the drill head with its top end either in a co-rotating manner when a sleeve adapter having parts which can be rotated relative to one another is connected to the lower back end of the pressure, flushing and recovery tube and with its lower part to the non-rotating sleeve, or the pressure, flushing and recovery tube is connected to the drill head in a non-rotating manner, when the adapter having parts which can be rotated relative to one another is mounted on the upper front end of the pressure, flushing and recovery tube and is connected to the sleeve for, in both cases, impacting the non-rotating.

7. The device according to claim 6, wherein the sleeve is seated with a lower end against a radially inwardly projecting projection at an upper end of the drill bit rotating along at the bottom of the initial tube in a rotation-free manner.

8. The device according to claim 6, wherein no fixing rod is installed for holding the sleeve.

9. The device according to claim 6, wherein a lower mouth region of the sleeve comprises spring steel elements projecting into the interior for securing the received drill core.

10. The device according to claim 6, wherein the sleeve adapter comprises an interposed sealing ring of plastic hard rubber.

11. The device according to claim 6, wherein the pressure, flushing and recovery tube is connected to the drill head in a non-rotating manner and the sleeve is impacted by the pressure, flushing and recovery tube with pressure, while a rotary disc body is seated as a drill head adapter with mutually rotatable parts at the top of the pressure, flushing and recovery tube and is connected to the rotating drill head.

12. The device according to claim 11, wherein the rotary disk body comprises an interposed sealing ring of plastic hard rubber.

13. The method according to claim 1, wherein after the sleeve has been filled, the drill head is detached from the drill tube.

* * * * *